US007751749B2

(12) United States Patent
Idehara et al.

(10) Patent No.: US 7,751,749 B2
(45) Date of Patent: Jul. 6, 2010

(54) IMAGE FORMING APPARATUS

(75) Inventors: Ryoh Idehara, Hyogo (JP); Nobuhiko Kita, Osaka (JP); Sei Onuma, Osaka (JP); Kazuyoshi Kondo, Osaka (JP); Yuusuke Furuichi, Osaka (JP); Genta Hagiwara, Ibaraki (JP); Kaoru Tada, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 79 days.

(21) Appl. No.: 12/285,524

(22) Filed: Oct. 8, 2008

(65) Prior Publication Data

US 2009/0110432 A1 Apr. 30, 2009

(30) Foreign Application Priority Data

Oct. 30, 2007 (JP) ..... 2007-282219

(51) Int. Cl.
*G03G 15/00* (2006.01)
*G03G 21/00* (2006.01)

(52) U.S. Cl. ..... 399/118; 399/125

(58) Field of Classification Search ..... 399/125, 399/118, 107, 110; 347/138, 152
See application file for complete search history.

(56) References Cited

U.S. PATENT DOCUMENTS 5,291,249 A * 3/1994 Lee ..... 399/118 X
6,252,619 B1 * 6/2001 Ueda et al. ..... 399/125 X
6,785,502 B2 8/2004 Kondoh ..... 399/313
7,272,340 B2 * 9/2007 Song ..... 399/125 X
2001/0021321 A1 * 9/2001 Kikuchi et al. ..... 399/118
2007/0110473 A1 5/2007 Kondo et al. ..... 399/117
2007/0110475 A1 5/2007 Idehara et al. ..... 399/118
2007/0166073 A1 7/2007 Idehara et al. ..... 399/110
2007/0246638 A1 10/2007 Idehara et al. ..... 248/677
2008/0007935 A1 1/2008 Kondo et al. ..... 361/829
2008/0050146 A1 2/2008 Kita et al. ..... 399/107
2008/0063425 A1 3/2008 Idehara et al. ..... 399/93
2008/0075502 A1 3/2008 Tada et al. ..... 399/111
2009/0074446 A1 * 3/2009 Idehara et al. ..... 399/107

FOREIGN PATENT DOCUMENTS

JP 2849978 11/1998
JP 2007-164128 6/2007
JP 2007-192894 8/2007

OTHER PUBLICATIONS

Abstract of JP 07-209943 published Aug. 11, 1995.

* cited by examiner

*Primary Examiner*—Sophia S Chen
(74) *Attorney, Agent, or Firm*—Harness, Dickey & Pierce, P.L.C.

(57) ABSTRACT

When a lever is pulled upwards, an engaging member comes into contact with a retracted contacting member. An optical writing device rotates with a hooking member at a center and is lifted. As a result, positions of a first reference position component and a second reference position component switches from a contacting position to a retracted position. When the lever is pulled downward, the engaging member separates from the retracted contacting member. The optical writing device rotates in a counter-clockwise direction with the hooking member as the center. As a result, the positions of the reference position components switch from the retracted position to the contacting position. The reference position components come into contact with positioning members.

9 Claims, 9 Drawing Sheets

IMAGE FORMING APPARATUS

CROSS-REFERENCE TO RELATED APPLICATIONS

The present application claims priority to and incorporates by reference the entire contents of Japanese priority document 2007-282219 filed in Japan on Oct. 30, 2007.

BACKGROUND OF THE INVENTION

1. Field of the Invention

The present invention relates to an image forming apparatus.

2. Description of the Related Art

In a typical electrophotographic image forming apparatus, a latent image writing unit, such as a laser writing device that optically scans a surface using laser light, writes a latent image on a latent image carrier. The latent image carrier is, for example, a uniformly charged photoreceptor. In an image forming apparatus such as this, depending on a layout within the device, the latent image writing unit becomes an obstruction and results in degradation in the maintainability of the latent image carrier and various peripheral devices. The various peripheral devices include a developing unit or a cleaning unit provided near the latent image carrier.

In Japanese Patent Application Laid-open No. 2849978, an image forming apparatus is described in which a latent image writing unit is fixed to an opening-and-closing cover that can be opened and closed with respect to a fixed cover, and a latent image carrier is fixed to the fixed cover. The fixed cover is a portion of an enclosure of the image forming apparatus. The latent image writing unit is widely separated from a latent image carrier when the opening-and-closing cover is opened. Because the latent image writing unit is retracted from a position opposing the latent image carrier when the opening-and-closing cover is opened, the latent image carrier and peripheral devices thereof are externally exposed, thereby improving maintainability of the latent image carrier and the peripheral devices.

However, sometimes the opening-and-closing cover rattles against the fixed cover resulting in an error in the relative positions of the latent image writing unit and the latent image carrier. Such error leads to degradation in writing position accuracy of the latent image writing unit.

Therefore, the present applicant has proposed an image forming apparatus described in Japanese Patent Application Laid-open No. 2006-157380 (referred to, hereinafter, as "previous application"). In the image forming apparatus described in the previous application, when the opening-and-closing cover is in a closed state, a biasing member biases a reference position component included in a latent image writing unit that is fixed to the opening-and-closing cover. The reference position component comes into contact with a positioning member within the image forming apparatus. As a result, the latent image writing unit can be accurately positioned with respect to a latent image carrier that is fixed to the fixed cover within the image forming apparatus. In other words, decrease in the writing position accuracy of the latent image writing unit can be prevented.

However, when the opening-and-closing cover is closed, the reference position component can collide with the positioning member. Positions of lenses, mirrors, and the like within a casing of the latent image writing unit can shift due to the collision resulting into degraded writing position accuracy of the latent image writing unit.

SUMMARY OF THE INVENTION

It is an object of the present invention to at least partially solve the problems in the conventional technology.

According to an aspect of the present invention, there is provided an image forming apparatus including a latent image carrier that carries a latent image; a latent image writing unit that writes the latent image on the latent image carrier; a holding body that can swing between an open position and a closed position with respect to an apparatus main body with a rotation axis provided on the apparatus main body as a center while holding the latent image writing unit, in which a reference position component is provided at a positioning reference position of the latent image writing unit, a positioning member is provided within the apparatus main body to position the latent image writing unit in relation to the latent image carrier when the holding body is in the closed position, and the reference position component is biased by a biasing member so as to come into contact with the positioning member; a mechanism that puts, when the holding body is in the closed position, the positioning member and the reference position component in any one of a contacting state in which the positioning member and the reference position component are in contact and a non-contacting state in which the positioning member and the reference position component are not in contact; and a switching member configured to switch between the contacting state and the non-contacting state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are below described with reference to the attached drawings.

An electrophotographic printer (hereinafter, "printer") according to an embodiment will be described as an image forming apparatus to which the present invention is applied.

Figure 1:
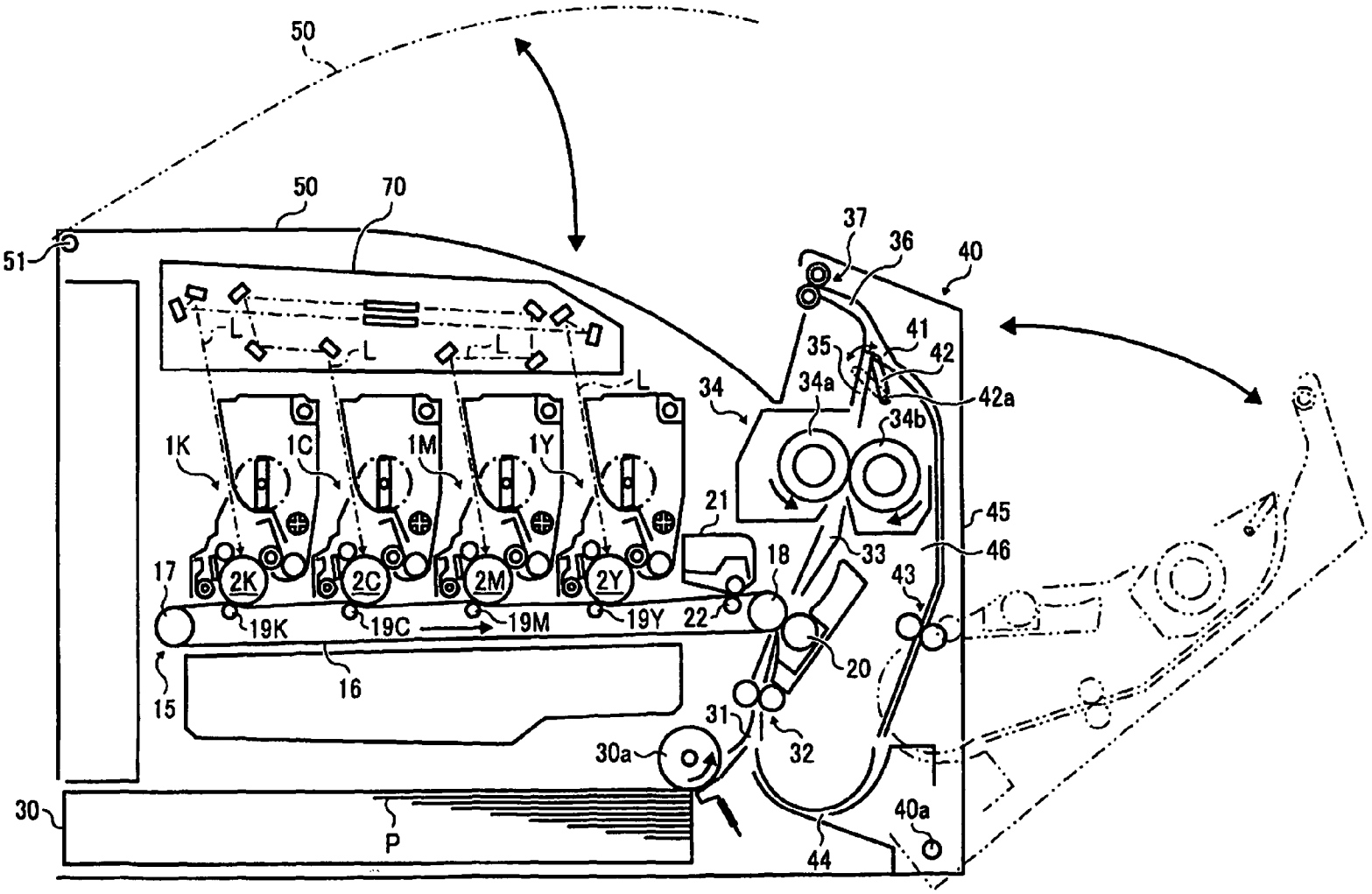
FIG. 1 is an overall configuration diagram of a printer according to an embodiment of the present invention.

First, a basic configuration of the printer will be described. FIG. 1 is an overall configuration diagram of the printer. The printer includes four processing units 1Y, 1M, 1C, and 1K. The processing unit 1Y forms a yellow (Y) toner image. The processing unit 1M forms a magenta (M) toner image. The processing unit 1C forms a cyan (C) toner image. The processing unit 1K forms a black (K) toner image. The processing unit 1Y, the processing unit 1M, the processing unit 1C, and the processing unit 1K each use a toner of a different color as an image forming material, the colors being yellow (Y), cyan (C), magenta (M), and black (K). Apart from the colors of the image forming material, the processing unit 1Y, the processing unit 1M, the processing unit 1C, and the processing unit 1K have similar configuration. The processing unit 1Y, the processing unit 1M, the processing unit 1C, and the processing unit 1K are replaced when a life span is reached.

Figure 2:
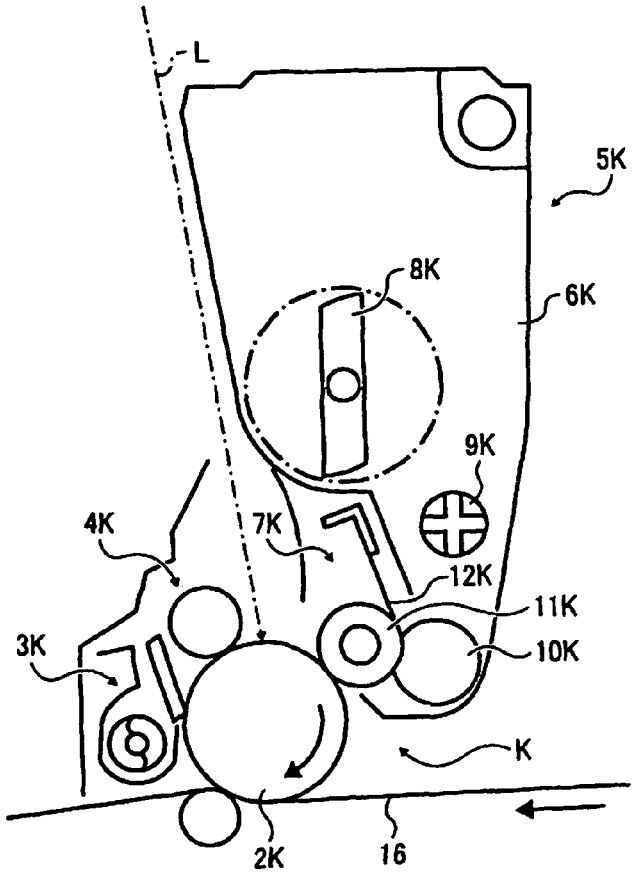
FIG. 2 is an enlarged configuration diagram of a processing unit for black in the printer.

The processing unit 1K will be described in detail as an example. As shown in FIG. 2, the processing unit 1K includes a drum-shaped photoreceptor 2K, a cleaning unit 3K, a neutralizing unit (not shown), a charging unit 4K, a developing unit 5K, and the like. The photoreceptor 2K serves as a latent image carrier. The photoreceptor 2K, the cleaning unit 3K, the neutralizing unit, the charging unit 4K, the developing unit 5K, and the like can be integrally attached to and removed from a main body of the printer. Consumable parts can be simultaneously replaced.

The charging unit 4K uniformly charges a surface of the photoreceptor 2K. The photoreceptor 2K is rotated in a clockwise direction in FIG. 2 by a driver (not shown). An electrostatic latent image for K is formed on the photoreceptor 2K when the uniformly-charged surface of the photoreceptor 2K is exposed to scanned with a laser light L. The developing unit 5K develops the electrostatic latent image for K using a K toner (not shown) and forms a K-toner image. The K-toner image is then intermediate-transferred onto an intermediate transfer belt 16.

The cleaning unit 3K removes untransferred toner remaining on the surface of the photoreceptor 2K after the intermediate-transfer. The neutralizing unit neutralizes charge remaining on the photoreceptor 2K after the cleaning by the cleaning unit 3K. The surface of the photoreceptor 2K is initialized by this neutralization and prepared for a subsequent image forming operation.

A Y-toner image is similarly formed on a photoreceptor 2Y in the processing unit 1Y and intermediate-transferred onto the intermediate transfer belt 16. An M-toner image is similarly formed on a photoreceptor 2M in the processing unit 1M and intermediate-transferred onto the intermediate transfer belt 16. A C-toner image is similarly formed on a photoreceptor 2C in the processing unit 1C and intermediate-transferred onto the intermediate transfer belt 16.

The developing unit 5K includes an oblong hopper 6K and a developing section 7K. The hopper 6K stores the K toner (not shown). An agitator 8K, a stirring paddle 9K, a toner supplying roller 10K, and the like are disposed within the hopper 6K. The agitator 8K is rotatably driven by a driving member (not shown). The stirring paddle 9K is provided below the agitator 8K in a vertical direction and is rotatably driven by a driving member (not shown). The toner supplying roller 10K is provided below the stirring paddle 9K in the vertical direction and is rotatably driven by a driving member (not shown).

The K toner within the hopper 6K moves towards the toner supplying roller 10K by its own weight, while being stirred by the rotational drive of the agitator 8K and the stirring paddle 9K. The toner supplying roller 1OK includes a metal core and a roller section covering a front surface of the metal core. The roller section is formed from a foamed resin or the like. The K toner within the hopper 6 is deposited onto a front surface of the roller section, and the roller section rotates.

A developing roller 11K, a thinning blade 12K, and the like are disposed within the developing section 7K of the developing unit 5K. The developing roller 11K rotates while being in contact with the photoreceptor 2K and the toner supplying roller 10K. A tip of the thinning blade 12K is in contact with a front surface of the developing roller 11K. The K toner deposited onto the toner supplying roller 10K within the hopper 6K is supplied to the front surface of the developing roller 11K at a contacting member between the developing roller 11K and the toner supplying roller 10K. When the supplied K toner passes through a contacting member between the developing roller 11K and the thinning blade 12K in accompaniment with the rotation of the developing roller 11K, a layer thickness of the K toner on the front surface of the developing roller 11K is restricted. After layer thickness restriction, the K toner adheres to an electrostatic latent image for K at a developing area that is a contacting member between the developing roller 11K and the photoreceptor 2K. As a result, the electrostatic latent image for K is developed into the K toner image.

The processing unit 1K for K has been described with reference to FIG. 2. The processing unit 1Y for Y forms a Y-toner image on a front surface of the photoreceptor 2Y by a similar process. The processing unit 1M for M forms an M-toner image on a front surface of the photoreceptor 2M by a similar process. The processing unit 1C for C forms a C-toner image on a front surface of the photoreceptor 2C by a similar process.

As shown in FIG. 1, an optical writing device 70 is disposed above the processing unit 1Y, the processing unit 1M, the processing unit 1C, and the processing unit 1K in the vertical direction. The optical writing device 70 serves as a latent image writing unit. The optical writing device 70 optically scans the photoreceptor 2Y in the processing unit 1Y, the photoreceptor 2M in the processing unit 1M, the photoreceptor 2C in the processing unit 1C, and the photoreceptor 2K in the processing unit 1K using the laser light L emitted from a laser diode based on image information. As a result of such optical scanning, a latent image for Y is formed on the photoreceptor 2Y, a latent image for M is formed on the photoreceptor 2M, a latent image for C is formed on the photoreceptor 2C, and a latent image for K is formed on the photoreceptor 2K. The optical writing device 70 irradiates a photoreceptor using a plurality of optical lenses and mirrors while polarizing a laser light (L) emitted from a light source in a main scanning direction by a polygon mirror rotatably driven by a polygon motor (not shown). The optical writing device 70 that performs optical writing using light emitting diode (LED) light emitted from a plurality of LED in an LED array can also be used.

A transferring unit 15 is disposed below the processing unit 1Y, the processing unit 1M, the processing unit 1C, and the processing unit 1K in the vertical direction. The transferring unit 15 moves the endless intermediate transfer belt 16 in a counter-clockwise direction in FIG. 1, while holding the intermediate transfer belt 16 in a tensioned state. The transferring unit 15 serves as a transferring unit. The transferring unit 15 includes a driver roller 17, a driven roller 18, four primary transfer rollers, a secondary transfer roller 20, a belt cleaner 21, a cleaning backup roller 22, and the like, in addition to the intermediate transfer belt 16. The four primary transfer rollers are a primary transfer roller 19Y, a primary transfer roller 19M, a primary transfer roller 19C, and a primary transfer roller 19K.

The intermediate transfer belt 16 is held in a tensioned state by the driver roller 17, the driven roller 18, the cleaning backup roller 22, the primary transfer roller 19Y, the primary transfer roller 19M, the primary transfer roller 19C, and the primary transfer roller 19K disposed inside the loop formed by the intermediate transfer belt 16. The intermediate transfer belt 16 moves in the counter-clockwise direction in FIG. 1 by a rotational force of the driver roller 17 driven in the counter-clockwise direction by a driver (not shown). The primary transfer roller 19Y, the primary transfer roller 19M, the primary transfer roller 19C, and the primary transfer roller 19K respectively sandwich the endlessly moving intermediate transfer belt 16 between the primary transfer roller 19Y and the photoreceptor 2Y, the primary transfer roller 19M and the photoreceptor 2M, the primary transfer roller 19C and the photoreceptor 2C, and the primary transfer roller 19K and the photoreceptor 2K. Because the intermediate transfer belt 16 is sandwiched, a primary transfer nip for Y at which the front surface of the intermediate transfer belt 16 and the photoreceptor 2Y come into contact is formed. A primary transfer nip for M at which the front surface of the intermediate transfer belt 16 and the photoreceptor 2M come into contact is formed. A primary transfer nip for C at which the front surface of the intermediate transfer belt 16 and the photoreceptor 2C come into contact is formed. A primary transfer nip for K at which the front surface of the intermediate transfer belt 16 and the photoreceptor 2Y come into contact is formed.

A primary transfer bias is respectively applied to the primary transfer roller 19Y, the primary transfer roller 19M, the primary transfer roller 19C, and the primary transfer roller 19K by a transfer bias power supply (not shown). As a result, a transfer field is formed between the electrostatic latent images on the photoreceptor 2Y, the photoreceptor 2M, the photoreceptor 2C, and the photoreceptor 2K, and the primary transfer roller 19Y, the primary transfer roller 19M, the primary transfer roller 19C, and the primary transfer roller 19K. A transfer charging unit, a transfer brush, and the like can be used instead of the primary transfer roller 19Y, the primary transfer roller 19M, the primary transfer roller 19C, and the primary transfer roller 19K.

When the Y-toner image formed on the front surface of the photoreceptor 2Y of the processing unit 1Y for Y proceeds to the primary transfer nip for Y, described above, by the rotation of the photoreceptor 2Y, the Y-toner image is primary-transferred onto the intermediate transfer belt 16 from the photoreceptor 2Y as a result of effects of the transfer field and nip pressure. When the intermediate transfer belt 16 onto which the Y-toner image has been primary-transferred in this way passes through the primary transfer nip for C, the primary transfer nip for M, and the primary transfer nip for K as a result of the endless movement of the intermediate transfer belt 16, the M-toner image on the photoreceptor 2M, the C-toner image on the photoreceptor 2C, and the K-toner image on the photoreceptor 2K are primary-transferred onto the Y-toner image in a sequentially overlapping manner. As a result of the overlapping primary transfers, toner images in four colors are formed on the intermediate transfer belt 16.

The secondary transfer roller 20 of the transferring unit 15 is disposed on an outer side of the loop formed by the intermediate transfer belt 16. The secondary transfer roller 20 sandwiches the intermediate transfer belt 16 between the secondary transfer roller 20 and the driven roller 18 on the inner side of the loop. As a result of the intermediate transfer belt 16 being sandwiched, a secondary transfer nip at which the front surface of the intermediate transfer belt 16 and the secondary transfer roller 20 come into contact is formed. A secondary transfer bias is applied to the secondary transfer roller 20 by a transfer bias power supply (not shown). As a result, a secondary transfer field is formed between the secondary transfer roller 20 and the driven roller 18. The driven roller 18 is grounded.

A paper feeding cassette 30 is disposed below the transferring unit 15 in the vertical direction. The paper feeding cassette 30 that stores sheets of recording paper P in a stacked state can be attached to and detached from an enclosure of the printer in a sliding manner. In the paper feeding cassette 30, a paper feeding roller 30*a* is in contact with a topmost sheet of recording paper P in the stack. As the paper feeding roller 30*a* rotates in the counter-clockwise direction in FIG. 1 at a predetermined timing, the sheet of recording paper P is sent towards a paper feeding path 31.

A pair of registration rollers 32 is disposed near an end of the paper feeding path 31. The registration rollers 32 stops rotation of each resist roller when the recording paper P sent from the paper feeding cassette 30 is sandwiched between the registration rollers 32. The registration rollers 32 re-start rotation-drive at a timing synchronizing passage of the sandwiched recording paper P within the above-described secondary transfer nip with the four toner images on the intermediate transfer belt 16. The recording paper P is sent towards the secondary transfer nip.

The four toner images on the intermediate transfer belt 16 placed in close contact with the recording paper P by the secondary transfer nip are collectively secondary-transferred onto the recording paper P as a result of the effects of the secondary transfer field and the nip pressure. With white of the recording paper P, the toner images form a full-color toner image. When the recording paper P, on a front surface of which the full-color toner image is formed, passes through the secondary transfer nip, the recording paper P curves and separates from the secondary transfer roller 20 and the intermediate transfer belt 16. The recording paper P passes through a post-transfer carrying path 33 and is sent to a fixing device 34, described hereafter.

The transfer-residue toner that has not been transferred onto the recording paper P remains on the intermediate transfer belt 16 after passing through the secondary transfer nip. The transfer-residue toner is cleaned from the front surface of the intermediate transfer belt 16 by the belt cleaner 21 that is in contact with the front surface of the intermediate transfer belt 16. The cleaning backup roller 22 disposed on the inner side of the loop formed by the intermediate transfer belt 16 backs up belt cleaning by the belt cleaner 21 from the inner side of the loop.

The fixing device 34 forms a fixing nip by a fixing roller 34*a* and a pressure roller 34*b*. The fixing roller 34*a* includes a heat source, such as a halogen lamp (not shown). The pressure roller 34*b* rotates while contacting the fixing roller 34*a* with a predetermined amount of pressure. The recording paper P that is sent within the fixing device 34 is sandwiched within the fixing nip such that an unfixed toner image carrying surface of the recording paper P comes into close contact with the fixing roller 34*a*. The toners forming the toner images are softened by effects of heat and pressure. A full-color image is fixed.

The recording paper P ejected from within the fixing device 34 passes through a post-fixing carrying path 35 and reaches a branching point between a paper ejecting path 36 and a pre-reversal carrying path 41. A switching stub 42 is disposed on the post-fixing carrying path 35 side. The switching stub 42 is rotatably driven around a rotation axis 42*a* serving as a center. An area near an end of the post-fixing carrying path 35 is opened and closed by the rotation of the switching stub 42. At a timing at which the recording paper P is sent from the fixing device 34, the switching stub 42 stops at a rotation position indicated by a solid line in FIG. 1, and opens the area near the end of the post-fixing carrying path 35. As a result, the recording paper P proceeds to the paper ejecting path 36 from the post-fixing carrying path 35 and is sandwiched between a pair of paper ejecting rollers 37.

When one-side printing mode is selected by an input operation performed through use of an controlling section, such as a numeric keypad (not shown), a control signal sent from a personal computer (not shown), and the like, the recording paper P sandwiched between the paper ejecting rollers 37 is directly ejected outside of the printer. The recording paper P is then stacked onto a sheet placing section on an outer surface of an upper cover 50 of the enclosure.

On the other hand, when duplex printing mode is selected, when a rear end of the recording paper P being sent over the paper ejecting path 36 passes through the post-fixing carrying path 35 while a front end of the recording paper P is sandwiched between the paper ejecting rollers 37, the switching stub 42 rotates to a position indicated by a dashed-dotted line in FIG. 1. The area near the end of the post-fixing carrying path 35 closes. Almost simultaneously, the paper ejecting rollers 37 starts to rotate in reverse. The recording paper P is then carried such that the rear end becomes the front end of the recording paper P, and proceeds onto the pre-reversal carrying path 41.

In FIG. 1, one side end of the printer is a reversal unit 40 that can be opened and closed by being swung relative to a main body of the enclosure with a swinging axis 40*a* as a center. When the paper ejecting rollers 37 rotates in reverse, the recording paper P enters the pre-reversal carrying path 41 of the reversal unit 40 and is carried from an upper side to a lower side in the vertical direction. After passing between rollers of a reverse carrying rollers 43, the recording paper P enters a reverse carrying path 44 that curves in a semicircular shape. As the recording paper P is carried along the curved shape, a top surface and a bottom surface of the recording paper P is reversed. A traveling direction from the upper side to the lower side in the vertical direction is also reversed. The recording paper P is carried from the lower side to the upper side in the vertical direction. Then, after passing though the above-described paper feeding path 31, the recording paper P reenters the secondary transfer nip. After a full-color image is collectively secondary-transferred onto the other surface of the recording paper P, the recording paper P is ejected outside of the printer after passing through the post-transfer carrying path 33, the fixing device 34, the post-fixing carrying path 35, the paper ejecting path 36, and the paper ejecting rollers 37.

The reversal unit 40 includes an external cover 45 and a second swinging body 46. The external cover 45 can swing in relation to the main body of the enclosure. The second swinging body 46 can further swing in relation to the external cover 45. Specifically, the external cover 45 of the reversal unit 40 is held such as to swing with the swinging axis 40*a* as the center. The swinging axis 40*a* is provided on the enclosure of the printer main body. As a result of swinging, the external cover 45 including the second swinging body 46 held within the external cover 45 opens and closes in relation to the enclosure. As shown by a dotted line in FIG. 1, when the external cover 45 including the second swinging body 46 within is opened, the paper feeding path 31, the secondary transfer nip, the post-transfer carrying path 33, the fixing nip, the post-fixing carrying path 35, and the paper ejecting path 36, formed between the reversal unit 40 and the printer main body side, are separated vertically into two, and exposed externally. As a result, a sheet of paper jammed within the paper feeding path 31, the secondary transfer nip, the post-transfer carrying path 33, the fixing nip, the post-fixing carrying path 35, and the paper ejecting path 36 can be easily removed.

In a state in which the external cover 45 is open, the second swinging body 46 is held by the external cover 45 such as to swing with a swinging axis (not shown) as a center. The swinging axis is provided on the external cover 45. As a result of the swinging, when the second swinging body 46 is open in relation to the external cover 45, the pre-reversal carrying path 41 and the reverse carrying path 44 are separated vertically into two and exposed externally. As a result, a sheet of paper jammed within the pre-reversal carrying path 41 and the reverse carrying path 44 can be easily removed.

The upper cover of the enclosure of the printer is an opening and closing door of the enclosure. As indicated by an arrow in FIG. 1, the upper cover 50 is held to swing freely with an axial component 51 as a center. The axial component 51 serves as a rotation axis. When the upper cover 50 rotates by a predetermined angle in the counter-clockwise direction in FIG. 1, the upper cover 50 is open in relation to the enclosure. A maintenance and inspection opening is opened.

The processing unit 1Y, the processing unit 1M, the processing unit 1C, and the processing unit 1K are disposed above the intermediate transfer belt 16. The optical writing device 70 is disposed further above the processing unit 1Y, the processing unit 1M, the processing unit 1C, and the processing unit 1K. In a layout such as this, the optical writing device 70 is required to be retracted from directly above the processing unit 1Y, the processing unit 1M, the processing unit 1C, and the processing unit 1K to install and remove the processing unit 1Y, the processing unit 1M, the processing unit 1C, and the processing unit 1K through the above-mentioned maintenance and inspection opening. In a system in which the upper cover 50 is openable, such as that of printers, a following configuration can be considered for retracting the optical writing device 70. The optical writing device 70 is held by a frame within the enclosure or the like to allow sliding movement in the vertical direction. The optical writing device 70 is installed and removed in the vertical direction. Alternatively, a configuration can be considered in which one end side of the optical writing device 70 is held by a frame within the enclosure or the like to allow swinging movement in the vertical direction. The swinging movement of the optical writing device 70 is used to retract the optical writing device 70 from directly above the processing unit 1Y, the processing unit 1M, the processing unit 1C, and the processing unit 1K and to set the optical writing device 70 directly above the processing unit 1Y, the processing unit 1M, the processing unit 1C, and the processing unit 1K. Moreover, a configuration can be considered in which the optical writing device 70 is held on a bottom surface side of the upper cover 50 that can be opened and closed. With the opening and closing of the upper cover 50, the optical writing device 70 can be retracted from directly above the processing unit 1Y, the processing unit 1M, the processing unit 1C, and the processing unit 1K and set directly above the processing unit 1Y, the processing unit 1M, the processing unit 1C, and the processing unit 1K.

However, in any configuration, backlash of the optical writing device 70 that can slide or swing and backlash of the upper cover 50 cause an error in relative positions between the optical writing device 70 and each photoreceptor 2Y, photoreceptor 2M, photoreceptor 2C, and photoreceptor 2K within the enclosure. As a result of the error, the writing position accuracy of the optical writing device 70 decreases. The decrease in the writing position accuracy causes image blurring, image fall-off, vignetting, and the like. In a configuration in which a plurality of processing units are disposed, such as that of the printer, a shift in color matching also occurs.

Figure 3:
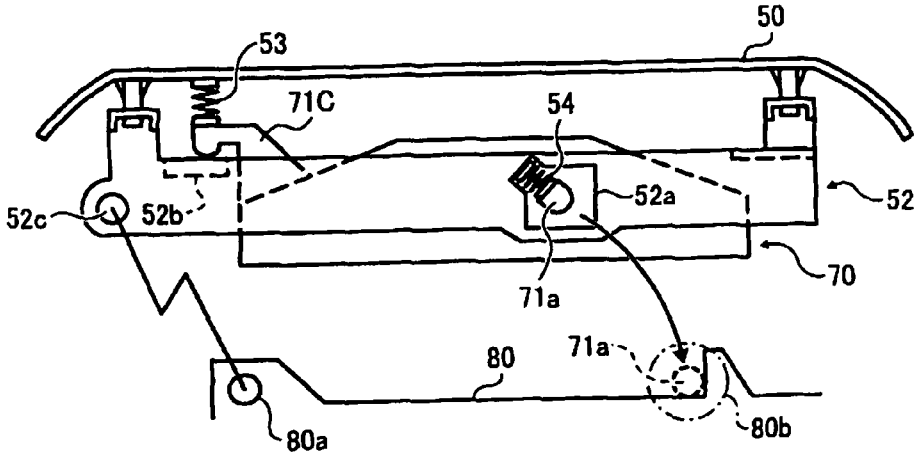
FIG. 3 is an enlarged configuration diagram of an upper cover and a peripheral configuration thereof in the printer.

FIG. 3 is an enlarged view of the upper cover 50 and a peripheral configuration thereof in the printer. A cover frame 52 serving as a holding body and the optical writing device 70 are fixed onto a back surface of the upper cover 50. The cover frame 52 includes a first frame, a second frame, a third frame (not shown), and a fourth frame (not shown). The first frame and the second frame are plate-shaped and oppose each other in a direction perpendicular to a paper surface of FIG. 3, with a predetermined distance therebetween. The third frame and the fourth frame connect the first frame and the second frame. The first frame and the second frame are provided such that a hold-opening 52*a* provided on the first frame of the cover frame 52 and the opening (not shown) provided on the second frame face each other.

On the other hand, the optical writing device 70 includes a columnar first reference position component 71*a* projecting from one side surface of a casing 71 of the optical writing device 70. The optical writing device 70 also includes a columnar second reference position component (not shown) projecting from another side surface of the casing 71. The first reference position component 71*a* and the second reference position component are provided such as to extend on a same axial line. The optical writing device 70 is positioned between the first frame and the second frame of the cover frame 52. The first reference position component 71*a* projecting from the one side surface and serving as a butting portion passes through the hold-opening 52*a* provided on the first frame of the cover frame 52. The second reference position component projecting from the other side surface passes through an opening provided on the second frame of the cover frame 52 (not shown). Moreover, the casing 71 of the optical writing device 70 includes a hook 71*c* on an upper section. The hook 71*c* is biased in a direction away from the upper cover 50 by a coil spring 53 provided on a lower surface bottom surface of the upper cover 50. The hook 71*c* is hooked onto a hooking member 52*b* of the cover frame 52. In this way, the optical writing device 70 is held to the cover frame 52 in a state in which the hook 71*c* is hooked onto the hooking member 52*b* while the first reference position component 71*a* projecting from the one side surface of the optical writing device 70 and the second reference position component projecting from the other side surface pass through the opening on the cover frame 52. The cover frame 52 can be integrally molded with a main body of the upper cover 50.

The hold-opening 52*a* provided on the first frame of the cover frame 52 and the opening (not shown) provided on the second frame are significantly larger than diameters of the first reference position component 71*a* and the second reference position component (not shown) of the optical writing device 70. Therefore, the optical writing device 70 is held by the cover frame 52 such as to have play within a range of clearance between the first reference position component 71*a* of the optical writing device 70 itself and the hold-opening 52*a* of the first frame and a range of clearance between the second reference position component of the optical writing device 70 itself and the opening of the second frame.

Figure 4:
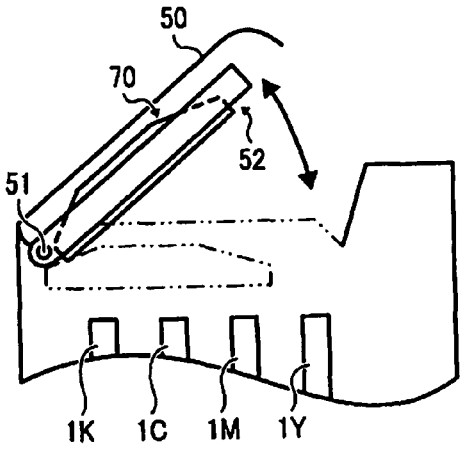
FIG. 4 is a schematic diagram for explaining an opening and closing operation of the upper cover.

An axis hole 52*c* is respectively formed on one end of the first frame and on one end of the second frame of the cover frame 52. On the other hand, a first side board 80 is erected on a main body side of the enclosure of the printer. A second side board (not shown) is also erected behind the first side board 80 in FIG. 3. The first side board 80 and the second side board oppose each other with a predetermined distance therebetween. An axis hole is respectively provided on one end of the first side board 80 and on one end of the second side board (the axis hole on the first side board 80 is 80*a*). One end of the cover frame 52 is inserted between the first side board 80 and the second side board. In this state, an axial component (not shown in FIG. 3; 51 in FIG. 1) is set such as to sequentially pass through an axis hole 80*a* in the first side board 80, the axis hole 52*c* in the first frame of the cover frame 52, the axis hole in the second frame of the cover frame 52, and the axis hole in the second side board. As a result, as shown in FIG. 4, the upper cover 50 and the optical writing device 70 are supported by the first side board 80 and the second side board of the enclosure such as to swing with the axial component 51 as a center. The first side board 80 and the second side board of the enclosure serve as a writing device supporting member.

The optical writing device 70 held by the upper cover 50 can move between an open position and a closed position in accompaniment with opening and closing operations of the upper cover 50. At the open position, the optical writing device 70 does not face any of the processing unit 1Y, the processing unit 1M, the processing unit 1C, and the processing unit 1K that are aligned horizontally. At the closed position, the optical writing device 70 faces each of the processing unit 1Y, the processing unit 1M, the processing unit 1C, and the processing unit 1K.

Hooks (not shown) are respectively provided on the first frame and on the second frame of the cover frame 52. When the upper cover 50 is closed, the hooks engage with an expansion pin (not shown) provided on the first side board 80 and the second side board within the enclosure. As a result of engagement, the cover frame 52 that swings is locked.

As shown in FIG. 3, a first biasing coil spring 54 is fixed onto the first frame of the cover frame 52. The first biasing coil spring 54 serves as a biasing member that biases the first reference position component 71*a* in an oblique direction, from an upper left direction to a lower right direction. The first reference position component 71*a* passes through the hold-opening 52*a* of the cover frame 52. In FIG. 3, although the first reference position component 71*a* is shown to be at a center position of the hold-opening 52*a*, when the upper cover 50 is opened, the optical writing device 70 is held by the cover frame 52 in a state in which the first reference position component 71*a* biased by the first biasing coil spring 54 is pressed against a corner of inner walls of the hold-opening 52*a*. A second biasing coil spring (not shown) is fixed onto the second frame of the cover frame 52. The second biasing coil spring serves as a second biasing member that biases the second reference position component towards an inner wall of the opening. The second reference position component passes through the opening of the second frame.

Figure 5:
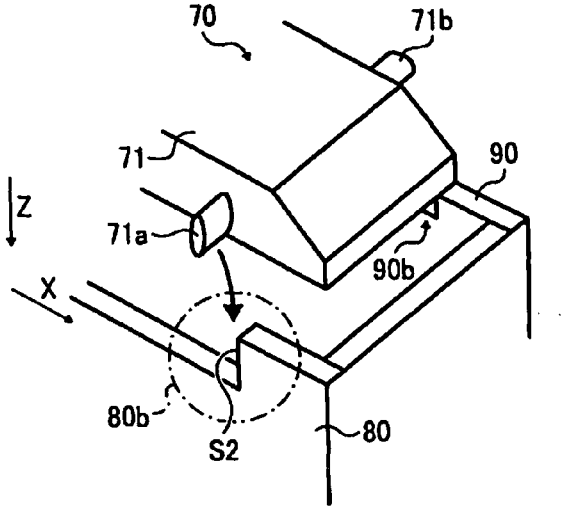
FIG. 5 is a perspective view of a right end section within an enclosure of the printer.
Figure 6:
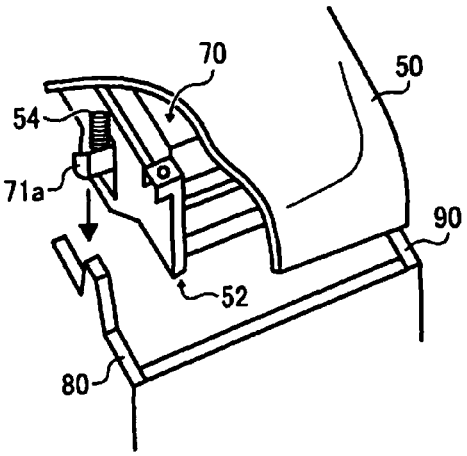
FIG. 6 is an exploded perspective view of a right end section of the printer.

At the same time, as shown in FIG. 5 and FIG. 6, a first positioning member 80*b* is provided on an upper section of the first side board 80 within the enclosure. The first positioning member 80*b* is a butted portion used to position the optical writing device 70 by butting the optical writing device 70 against the first positioning member 80*b*. The optical writing device 70 moves to the closed position in accompaniment with the upper cover 50 being closed. The first positioning member 80*b* has two contact surfaces that come into contact with the first reference position component 71*a* biased by the first biasing coil spring (54 in FIG. 6). A first contact surface is an X-direction restriction contact surface S2 that restricts movement of the first reference position component 71*a* in an X-direction indicated by an arrow X in FIG. 5. The X-direction in FIG. 5 is perpendicular to a direction perpendicular to the paper surface of the diagram that is a latent image writing direction (main scanning direction) of the optical writing device 70. The X-direction is also a same direction as a left-right direction (left-right direction in FIG. 5) that is a movement direction at a latent image writing position (optical writing position) on the front surfaces of the photoreceptor 2Y, the photoreceptor 2M, the photoreceptor 2C, and the photoreceptor 2K within the enclosure. A second contact surface is a Z-direction restriction contact surface S3 that restricts movement of the first reference position component 71*a* in a Z-direction indicated by an arrow Z in FIG. 5.

Figure 7:
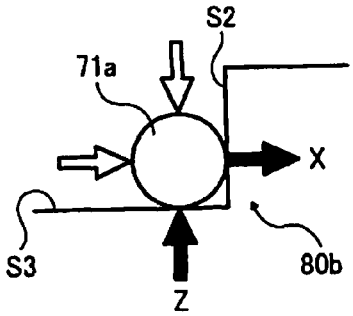
FIG. 7 is a schematic diagram for explaining abutment of a first reference position component and a first positioning member.
Figure 8:
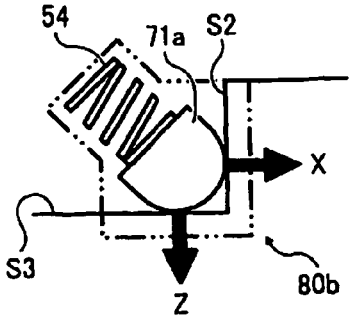
FIG. 8 is a schematic diagram for explaining biasing of the first reference position component.

As indicated by hollow arrows in FIG. 7, a biasing coil that biases the first reference position component 71*a* in the X-direction and a biasing coil that biases the first reference position component 71*a* in the Z-direction can be separately provided as first biasing coils (not shown) that bias the first reference position component 71*a*. However, in this case, cost increases and device size increases as a result of a number of coils increasing. Cost reduction and size reduction can be achieved by the first biasing coil spring 54 biasing the first reference position component 71*a* such as to move the first reference position component 71*a* in an oblique direction including an X-direction movement element and a Z-direction movement element, as in the printer configured as shown in FIG. 8. The same applies to a second biasing coil biasing the second reference position component (not shown).

The first biasing coil spring 54 shown in FIG. 3 biases the first reference position component 71*a* of the optical writing device 70 at the closed position in which the upper cover 50 is closed. The first biasing coil spring 54 butts the first reference position component 71*a* against the X-direction restriction contact surface S2 and the Z-direction restriction contact surface S3 of the first positioning member 80*b* shown in FIG. 5. As a result, an end of the optical writing device 70 at the closed position is positioned in the X-direction and the Z-direction.

In FIG. 5, a second positioning member 90*b* is provided on an upper section of a second back side board 90 that opposes the first side board 80 of the enclosure with a predetermined distance therebetween. The second positioning member 90*b* is a butted portion used to position the optical writing device 70 that has arrived at the closed position in accompaniment with the upper cover 50 being closed. The second positioning member 90*b* has two contact surfaces that come into contact with a second reference position component 71*b* biased by the second biasing coil spring (not shown).

The second biasing coil spring fixed onto the second frame (not shown) of the cover frame 52 biases the second reference position component 71*b* of the optical writing device 70 at the closed position. The second biasing coil spring butts the second reference position component 71*b* against the X-direction restriction contact surface and the Z-direction restriction contact surface of the second positioning member 90*b*. As a result, another end of the optical writing device 70 at the closed position is positioned in the X-direction and the Z-direction.

In the printer configured as described above, as a result of the optical writing device 70 being moved from the closed position to the open position as required through an opening operation of the upper cover 50, the optical writing device 70 can be widely separated from the processing unit 1Y, the processing unit 1M, the processing unit 1C, and the processing unit 1K that respectively include the photoreceptor 2Y, the photoreceptor 2M, the photoreceptor 2C, and the photoreceptor 2K and peripheral devices. As a result, the processing unit 1Y, the processing unit 1M, the processing unit 1C, and the processing unit 1K can be exposed. Maintainability of the processing unit 1Y, the processing unit 1M, the processing unit 1C, and the processing unit 1K can be improved.

As a result of reference position components of the optical writing device 70 at the closed position coming into contact with positioning members within the enclosure by biasing coils performing bias, the optical writing device 70 can be positioned in relation to the photoreceptor 2Y, the photoreceptor 2M, the photoreceptor 2C, and the photoreceptor 2K within the enclosure. Therefore, even when the cover frame 52 that holds the optical writing device 70 to allow movement and also moves itself moves with a certain degree of play, the optical writing device 70 can be positioned in relation to the photoreceptor 2Y, the photoreceptor 2M, the photoreceptor 2C, and the photoreceptor 2K within the enclosure at the closed position. The decrease in the writing position accuracy of the optical writing device 70 can be suppressed.

Next, a configuration of the printer according to the embodiment will be described.

Figure 9:
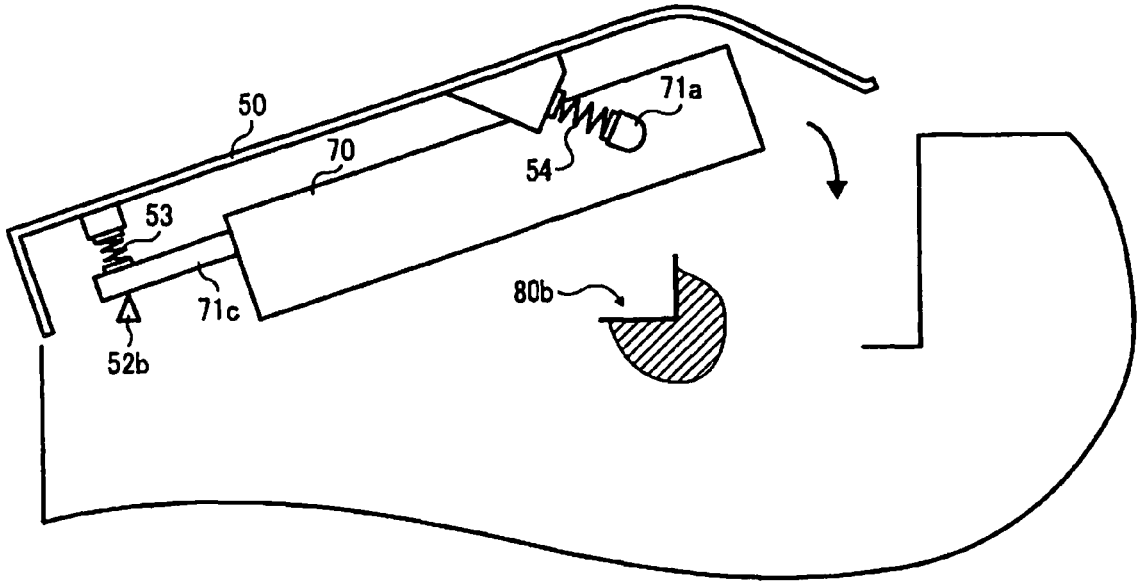
FIG. 9 is a diagram for explaining movement of the optical writing device from an open position to a closed position.
Figure 10:
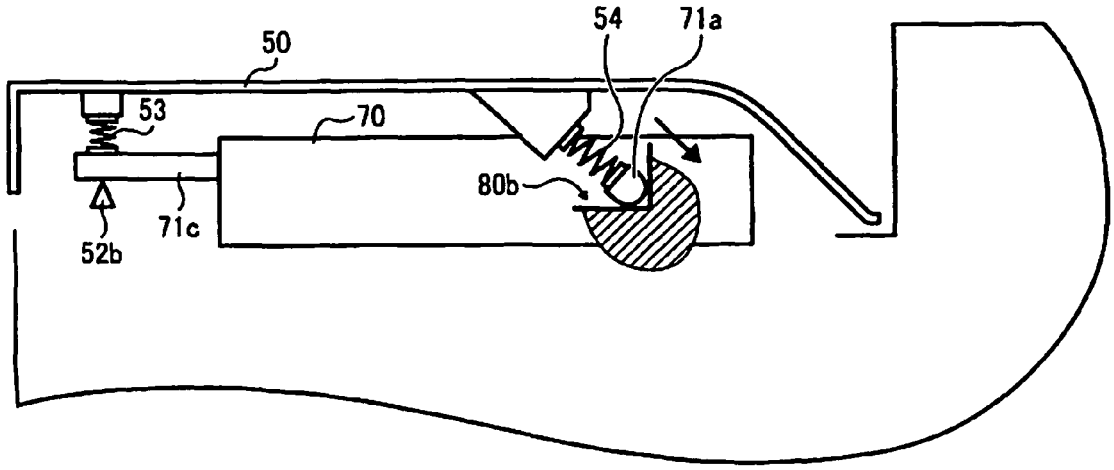
FIG. 10 is a diagram for explaining collision between the first reference position component and the first positioning member.

When the upper cover 50 is moved from the open position shown in FIG. 9 to the closed position shown in FIG. 10, the first reference position component 71*a* and the second reference position component 71*b* of the optical writing device 70 collide with the first positioning member 80*b* and the second positioning member 90*b*. As a result of the collision, the mirrors, the lenses, and the like positioned and fixed within a casing of the optical writing device 70 shift, possibly causing the writing position accuracy to decrease. According to the embodiment, the first biasing coil spring 54 is in a compressed state at the closed position in FIG. 10. The first biasing coil spring 54 stretches to a free length at the open position. Therefore, because the first reference position component 71*a* and the second reference position component 71*b* butt against the first positioning member 80*b* and the second positioning member 90*b* when the first biasing coil spring 54 is in a stretched state, namely in a state in which the first reference position component 71*a* and the second reference position component 71*b* are near the first positioning member 80*b* and the second positioning member 90*b*, this is disadvantageous in terms of collision.

Figure 11:
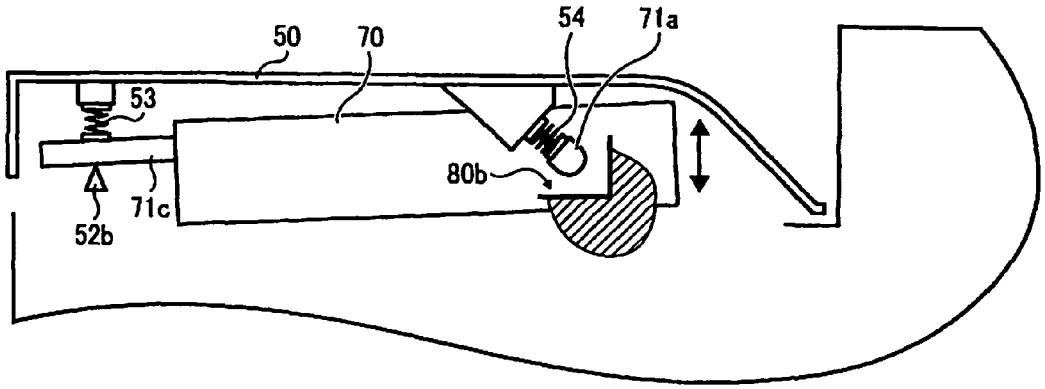
FIG. 11 is a diagram for explaining retracting of the first reference position component.

Therefore, according to the embodiment, as shown in FIG. 11, the printer is configured such that the optical writing device 70 tilts. The first reference position component 71*a* and the second reference position component 71*b* can be positioned at a retracted position and a contacting position. In the retracted position, the first reference position component 71*a* and the second reference position component 71*b* are not in contact with the first positioning member 80*b* and the second positioning member 90*b* at the closed position. In the contacting position, the first reference position component 71*a* and the second reference position component 71*b* are in contact with the first positioning member 80*b* and the second positioning member 90*b*. As a result, when the optical writing device 70 moves from the open position to the closed position, the first reference position component 71*a* and the second reference position component 71*b* stop colliding with the first positioning member 80*b* and the second positioning member 90*b* as a result of the first reference position component 71*a* and the second reference position component 71*b* being positioned in the retracted position. Shifting of the mirrors, the lenses, and the like positioned and fixed within the casing of the optical writing device 70 can be suppressed. As a result of the optical writing device being moved to become horizontal after the optical writing device 70 is moved to the closed position, the first reference position component 71*a* and the second reference position component 71*b* can be moved to the contact position. The first reference position component 71*a* and the second reference position component 71*b* can come into contact with the first positioning member 80*b* and the second positioning member 90*b*, and the optical writing device 70 can be positioned in relation to the photoreceptor 2Y, the photoreceptor 2M, the photoreceptor 2C, and the photoreceptor 2K within the enclosure at the closed position.

Figure 12:
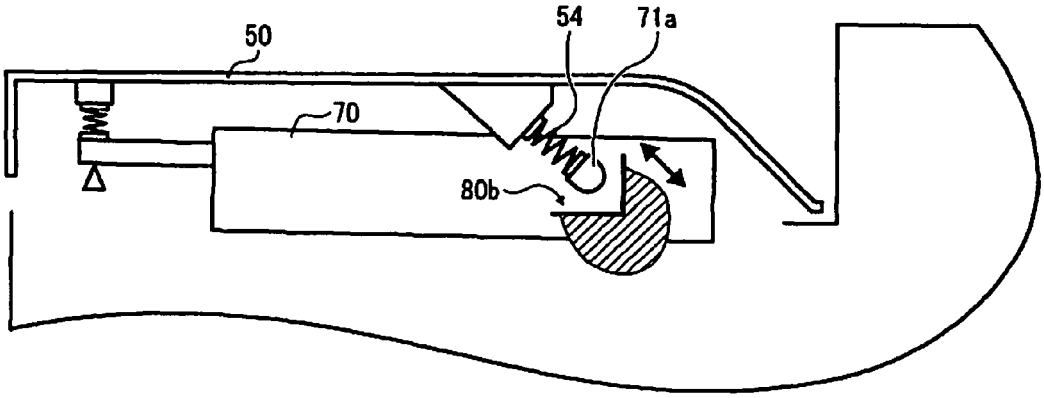
FIG. 12 is a diagram for explaining retracting of the first positioning member.

As shown in FIG. 12, the first positioning member 80*b* and the second positioning member 90*b* can be configured to be allowed to move to the retracting position. When the optical writing device 70 moves from the open position to the closed position, the first positioning member 80*b* and the second positioning member 90*b* can be positioned at the retracting position, thereby preventing the first reference position component 71*a* and the second reference position component 71*b* from colliding with the first positioning member 80*b* and the second positioning member 90*b*. The shifting of the mirrors, the lenses, and the like positioned and fixed within the casing of the optical writing device 70 can be suppressed. In this case, after the optical writing device 70 is moved to the closed position, the first positioning member 80*b* and the second positioning member 90*b* are moved to the contacting position. The first reference position component 71*a* and the second reference position component 71*b* come into contact with the first positioning member 80*b* and the second positioning member 90*b*, and the optical writing device 70 is positioned in relation to the photoreceptor 2Y, the photoreceptor 2M, the photoreceptor 2C, and the photoreceptor 2K within the enclosure at the closed position.

Figure 13:
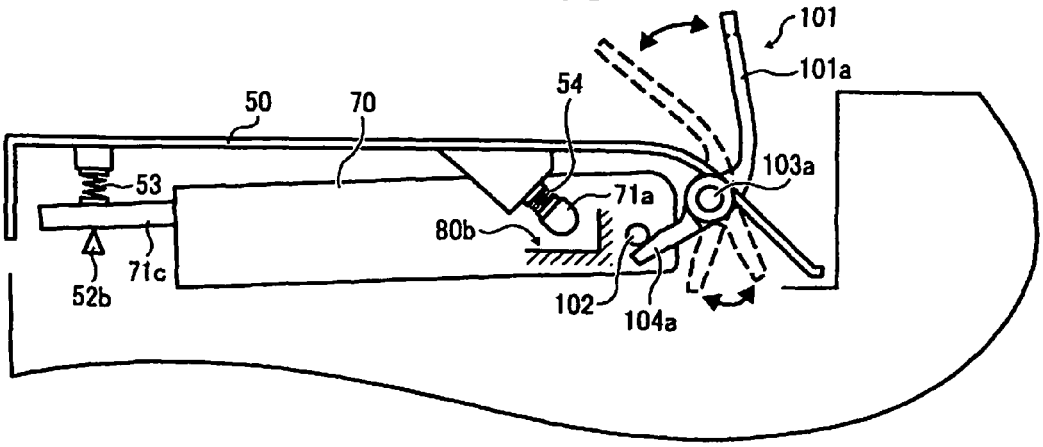
FIG. 13 is an overall configuration diagram of a first example.
Figure 14:
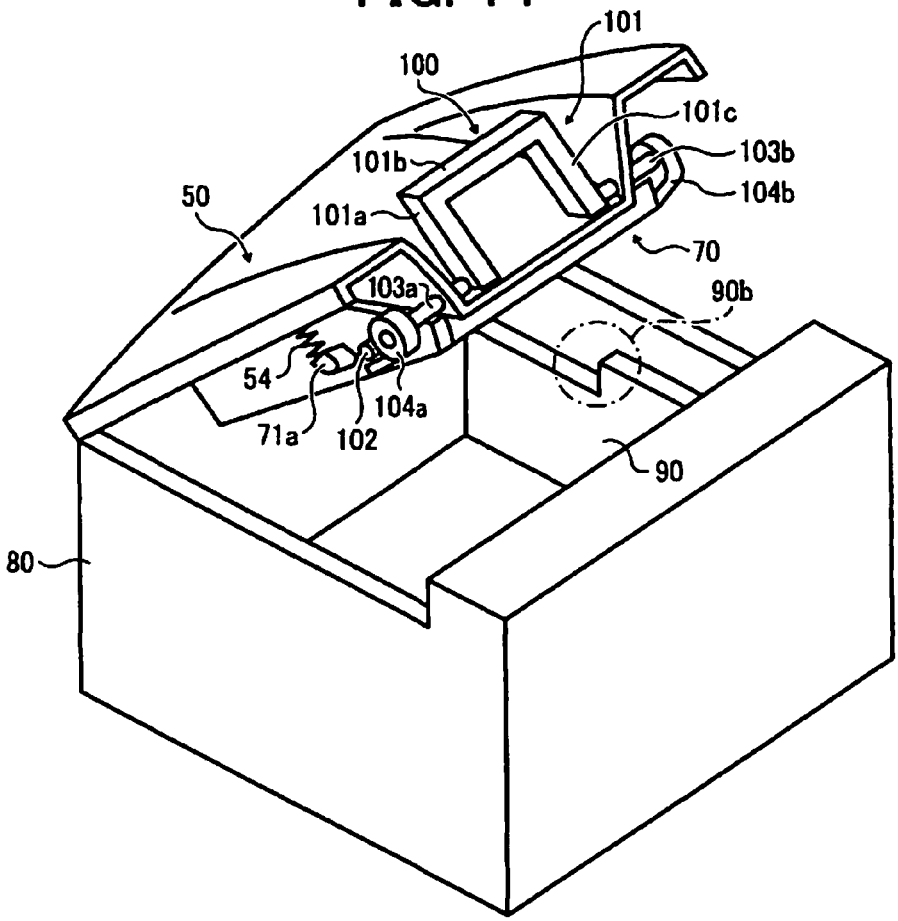
FIG. 14 is an overall perspective view of the first example.

FIG. 13 is an overall configuration diagram of a first example. FIG. 14 is an overall perspective view of the first example.

In the first example, a switching mechanism 100 tilts the optical writing device 70, thereby switching the positions of the first reference position component 71*a* and the second reference position component 71*b* to the retracted position.

As shown in FIG. 13 and FIG. 14, the switching mechanism 100 includes a lever 101 that serves as a switching controlling member. The lever 101 includes a first arm 101*a* on one side surface side and a second arm 101*c* on another side surface side. The first arm 101*a* and the second arm 101*c* are connected by a connecting member 101*b*. One end of a first axial component 103*a* is fixed onto a lower end of the first arm 101*a*. A second axial component 103*b* is fixed onto a lower end of the second arm 101*c*. The lever 101 is provided near an end of the upper cover 50 on the swinging side. The first axial component 103*a* passes through from one side surface of a lever housing 50*a* such as to rotate freely. The second axial component 103*b* passes through from another side surface of the lever housing 50*a* such as to rotate freely. A first engaging member 104*a* is fixed onto an axial end of the first axial component 103*a*. A second engaging member 104*b* is fixed onto the second axial component 103*b*.

A columnar first retracted contacting member 102 is provided on one side surface of the casing of the optical writing device 70 such as to project from the one side surface of the casing. A columnar second retracted contacting member (not shown) is provided on another side surface of the casing of the optical writing device such as to project from the other side surface of the casing.

When the optical writing device 70 moves to the open position, a user takes hold of the connecting member 101*b* of the lever 101 housed in the lever housing (not shown) provided on the upper cover 50 and pulls the lever 101 upwards from a lever-housed position that is a first position to a pulled-up position that is a second position. Then, the first engaging member 104*a* comes into contact with the first retracted contacting member 102 and the second engaging member 104*b* comes into contact with the second retracted contacting member (not shown). The optical writing device 70 rotates with the hooking member 52*b* as a center and is pulled upwards. As a result the positions of the first reference position component 71*a* and the second reference position component 71*b* switch from the contacting position to the retracted position.

In the first example, the lever 101 is attached to the upper cover 50. Therefore, when the lever 101 is pulled upwards, the upper cover 50 rotates with the axial component 51 as a center. The optical writing device 70 moves from the closed position to the open position. In other words, the lever 101 that is the switching controlling member also functions as a movement controlling member that controls movement of the optical writing device 70 between the closed position and the open position. As a result of the lever 101 functioning as the movement controlling member in this way, a number of components can be reduced compared to when a controlling member for moving a reference position component between a retracted position and a contacting position and the above-described movement controlling member are separately provided. As a result, cost reduction and size reduction can be achieved.

The optical writing device 70 can move to the open position, and the positions of the first reference position component 71*a* and the second reference position component 71*b* can switch from the contacting position to the retracted position simply by the lever 101 being pulled upwards. Therefore, an operation required to move the optical writing device 70 to the open position can be simplified, compared to when a switching controlling member for switching the positions of the first reference position component 71*a* and the second reference position component 71*b* and the above-described movement controlling member are separately provided.

When the optical writing device 70 moves from the open position to the closed position while the lever 101 is pulled upwards, because the first reference position component 71*a* and the second reference position component 71*b* are at the retracted position, the first reference position component 71*a* and the second reference position component 71*b* do not collide with the first positioning member 80*b* and the second positioning member 90*b*. Therefore, positions of optical components, such as the mirror, within the casing of the optical writing device 70 do not shift.

When the optical writing device 70 moves to the closed position, the first engaging member 104*a* separates from the first retracted contacting member 102 and the second engaging member 104*b* separates from the second retracted contacting member (not shown) when the lever 101 is pulled towards the lever-housed position. The optical writing device 70 then rotates in the clockwise direction in FIG. 13 with the hooking member 52*b* as the center. The positions of the first reference position component 71*a* and the second reference position component 71*b* switch from the retracted position to the contacting position. As a result, the first reference position component 71*a* and the second reference position component 71*b* come into contact with the first positioning member 80*b* and the second positioning member 90*b*, and the optical writing device 70 is positioned within the printer main body.

In the first example, a direction in which the lever 101 moves the optical writing device 70 is opposite of the direction in which the biasing coil spring 54 biases the optical writing device 70 (reference positioning component) Therefore, the positions of the first reference position component 71*a* and the second reference position component 71*b* can be switched from the retracted position to the contacting position by the first engaging member 104*a* and the second engaging member 104*b* being separated from the optical writing device 70 (retracted contacting member). As a result, a mechanism for switching the positions of the first reference position component 71*a* and the second reference position component 71*b* from the retracted position to the contacting position is not required to be provided. The number of components can be reduced. Cost reduction and size reduction can also be achieved.

When the optical writing device 70 is moving from the open position to the closed position, the lever 101 may fall, causing the first reference position component 71*a* and the second reference position component 71*b* to move from the retracted position to the contacting position. The first reference position component 71*a* and the second reference position component 71*b* may then collide with the first positioning member 80*b* and the second positioning member 90*b*. Therefore, when the optical writing device 70 is moving from the open position to the closed position, a locking mechanism can be provided that locks the lever 101 at the pulled-up position that is the second position to prevent the lever 101 from falling from the pulled-up position.

Figure 15:
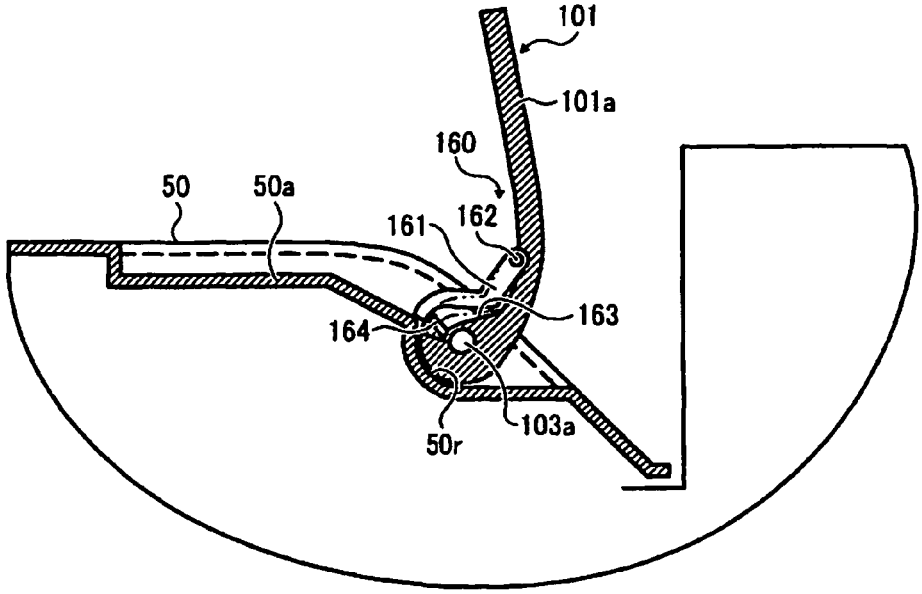
FIG. 15 is a diagram for explaining a locking mechanism.

FIG. 15 is an overall configuration diagram in which a locking mechanism 160 is provided. The first arm 101*a* is described hereafter. However, the second arm 101*c* is also provided with a similar locking mechanism.

As shown in FIG. 15, a cut-out section 163 is provided on the first arm 101*a* of the lever 101 on the upper cover 50 rotation axis side (axial component 51). A locking component 161 is provided in the cut-out section 163. A through-hole (not shown) is provided on an upper end of the locking component 161. A hinge screw 162 is inserted into the through-hole and screwed onto the first arm 101*a*. As a result, the locking component 161 is fixed onto the first arm 101*a* such as to rotate freely. Lower ends of the first arm 101*a* and the second arm 101*c* (not shown) are formed in a circular shape with an axial center of the first axial component 103*a* as a center. An R-section 50*r* is formed on the upper cover 50 such as to follow along the lower ends of the first arm 101*a* and the second arm 10*c*. A lower end of the locking component 161 also curves with the axial center of the first axial component 103*a* as a center. A biasing component 164, such as a coil spring, is provided between a surface of the lower end of the locking component 161 on the arm side and a lower end of the cut-out section 163. The biasing component 164 biases the lower end of the locking component 161 in a direction away from the axial center of the first axial component 103*a*. The lower end surface of the locking component 161 is a tapered surface following along a surface of the lever housing 50*a* on the upper cover 50.

When the lever 101 serving as the switching controlling member is housed in the lever housing 50*a*, the locking component 161 fights the biasing component 164 as a result of the R-section 50*r* of the upper cover 50 and is moved towards the first axial component 103*a* side. When the lever 101 is pulled upwards to the pulled-up position that is the second position shown in FIG. 15 from the state in which lever 101 is housed in the lever housing 50*a* (lever-housed position), the lower end of the locking component 161 slides with the R-section 50*r* of the upper cover 50. Therefore, the user pulls the lever 101 upwards while experiencing resistance. When the lever 101 is pulled upwards to the pulled-up position, the contact between the locking component 161 and the upper cover 50 is broken. The user stops experiencing the resistance and feels a so-called clicking. Through this, the user can know that the lever 101 has been pulled up to the pulled-up position. When the lever 101 has been pulled up to the pulled-up position, the contact between the locking component 161 and the upper cover 50 is broken and the lower end of the locking component 161 projects further than the R-section 50*r* of the upper cover 50. Therefore, even when the lever 101 starts to fall, a lower end surface of the locking component 161 butts against the lever housing 50*a* of the upper cover 50, preventing the lever 101 from falling. As a result, the lever 101 is prevented from falling from the pulled-up position that is the second position, when the optical writing device 70 moves from the open position to the closed position. Therefore, when the optical writing device 70 moves from the open position to the closed position, the first reference position component 71*a* and the second reference position component 71*b* can be positioned at the retracted position with certainty. The collision between the first reference position component 71*a* and the first positioning member 80*b*, and between the second reference position component 71*b* and the second positioning member 90*b* can be prevented with more certainty.

When the lever 101 is moved from the pulled-up position to the lever-housed position, as a result of the lever 101 being firmly pressed down, the locking component 161 is pressed towards the first arm 101*a* side by the lower end surface of the locking component 161 that is a tapered surface. The lever 101 can be moved from the pulled-up position to the lever-housed position, and the lever 101 can be housed in the lever housing 50*a*.

Figure 16:
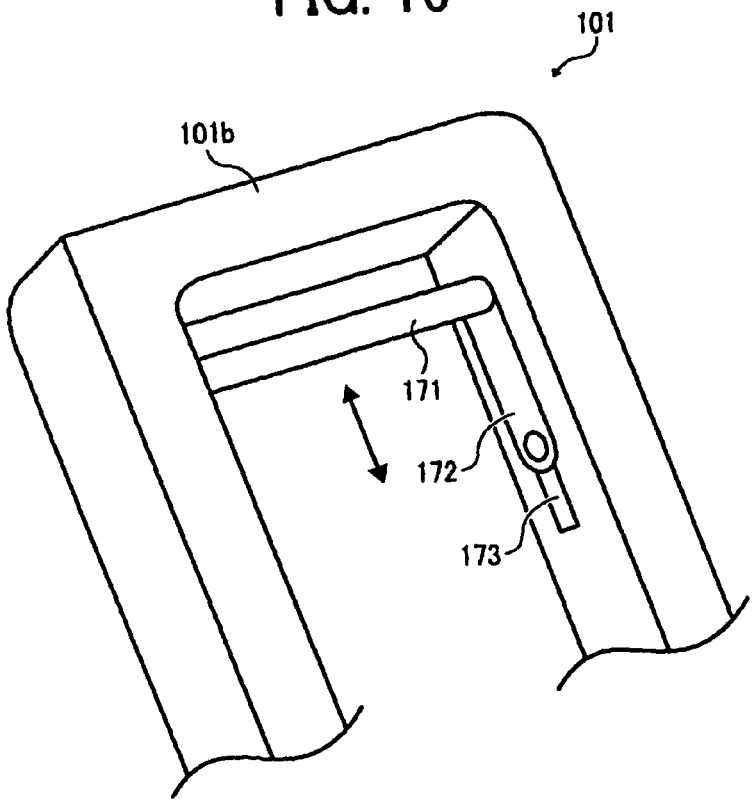
FIG. 16 is a perspective diagram of a release lever.

As shown in FIG. 16, a release lever 171 can be provided on the lever 101. The locked lever 101 can be released by the release lever 171 being pulled towards the connecting member 101*b* side of the lever 101.

Figure 17:
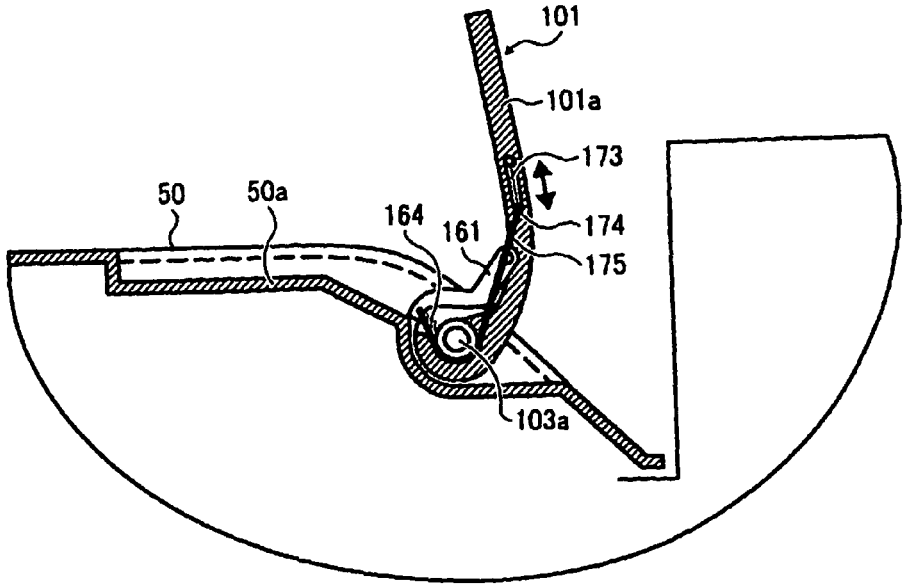
FIG. 17 is a diagram for explaining a release mechanism.

FIG. 17 is an overall configuration diagram of a release mechanism in which the locked lever 101 is released by an operation of the release lever 171. FIG. 17 is a diagram of the release mechanism provided on the first arm 101*a*. However, a similar release mechanism is also provided on the second arm 101*c*.

As shown in FIG. 16, a release arm 172 is provided on each end of the release lever 171, such as to respectively follow along the inner surfaces of the first arm 101*a* and the second arm 101*c*. A long hole 173 extending in the vertical direction is formed on the first arm 101*a* and on the second arm 101*c* of the lever 101. A projection 174 provided on a lower end of the release arm 172 is passes through the long hole 173. As shown in FIG. 17, one end of a linear component 175 is fixed onto a tip of the projection 174. Another end of the linear component 175 is fixed onto the lower end of the locking component 161. The axial component 103*a* suspends the linear component 175.

When the release lever 171 is pulled to the connecting member 101*b* side of the lever 101, the locking component 161 is pressed to the arm side of the lever 101 by the linear component 175. The locked lever 101 is released. When the lever 101 is pulled downward while the release lever 171 is pulled to the connecting member 101*b* side, the lever 101 can be moved from the pulled-up position to the lever-housed position. The lever 101 can be housed in the lever housing 50*a*. In this way, as a result of the release mechanism being provided, the lower end surface of the locking component 161 can be given a square shape. Compared to when the lower end surface of the locking component 161 is a tapered surface, the lever 101 can be locked with more certainty.

Figure 18:
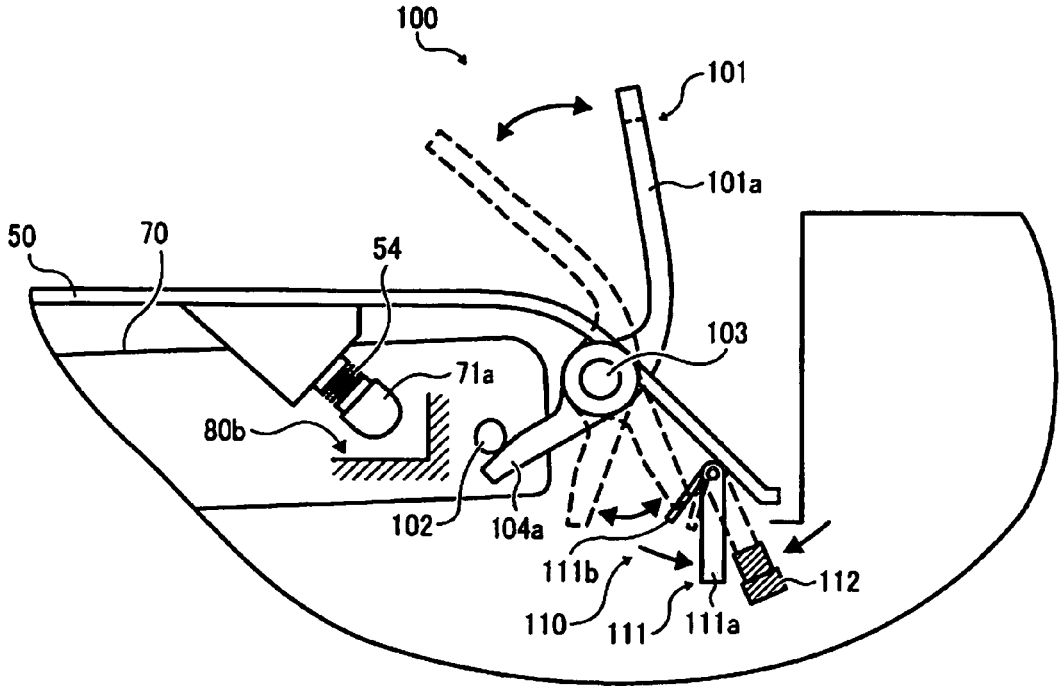
FIG. 18 is an overall configuration diagram of a second example.

FIG. 18 is an overall configuration diagram of the second example. In the second example, a detector 110 is provided. The detector 110 detects whether the first reference position component 71*a* and the second reference position component 71*b* are in the contacting position when the optical writing device 70 is in the closed position.

The detector 110 includes a swinging component 111 and an optical sensor 112. The swinging component 111 includes a filler 111*a* and a lever contacting member 111*b*. An upper end of the swinging component 111 is fixed onto one side surface side of the printer main body such as to swing freely.

The optical sensor 112 includes a light-emitting device (not shown) and a light-receiving device (not shown). The light-emitting device and the light-receiving device are disposed facing each other a predetermined distance apart.

After the lever 101 is pulled upwards, as indicated by the solid line in FIG. 18, and the optical writing device 70 is positioned at the closed position in a state in which the first reference position component 71*a* and the second reference position component 71*b* are in the retracted position, when the lever 101 is pulled downward to switch the positions of the first reference position component 71*a* and the second reference position component 71*b* to the contacting position, the lower end of the first engaging member 104*a* comes into contact with the lever contacting member 111*b* of the swinging component 111. When the lever 101 is pulled further downward, the swinging component 111 rotates in the counter-clockwise direction in FIG. 18. A lower end of the filler 111*a* is positioned at an opposing area at which the light-emitting device and the light-receiving device (not shown) of the optical sensor 112 face each other, thereby blocking light from the light-emitting device. As a result, the light-receiving device does not receive the light. The detector 110 detects that the first reference position component 71*a* and the second reference position component 71*b* are in the contacting position.

In this way, in the second example, as a result of the detector 110 detecting that the first reference position component 71*a* and the second reference position component 71*b* are in the contacting position, it can be detected that the optical writing device 70 is positioned in relation to the printer main body. Therefore, when control is performed such that an image forming operation is only performed when the detector 110 detects that the first reference position component 71*a* and the second reference position component 71*b* are in the contacting position, the image forming operation can be prevented from being performed when the optical writing device 70 is not positioned in relation to the printer main body. As a result, formation of abnormal images, such as an image with color shifting, can be suppressed.

Figure 19:
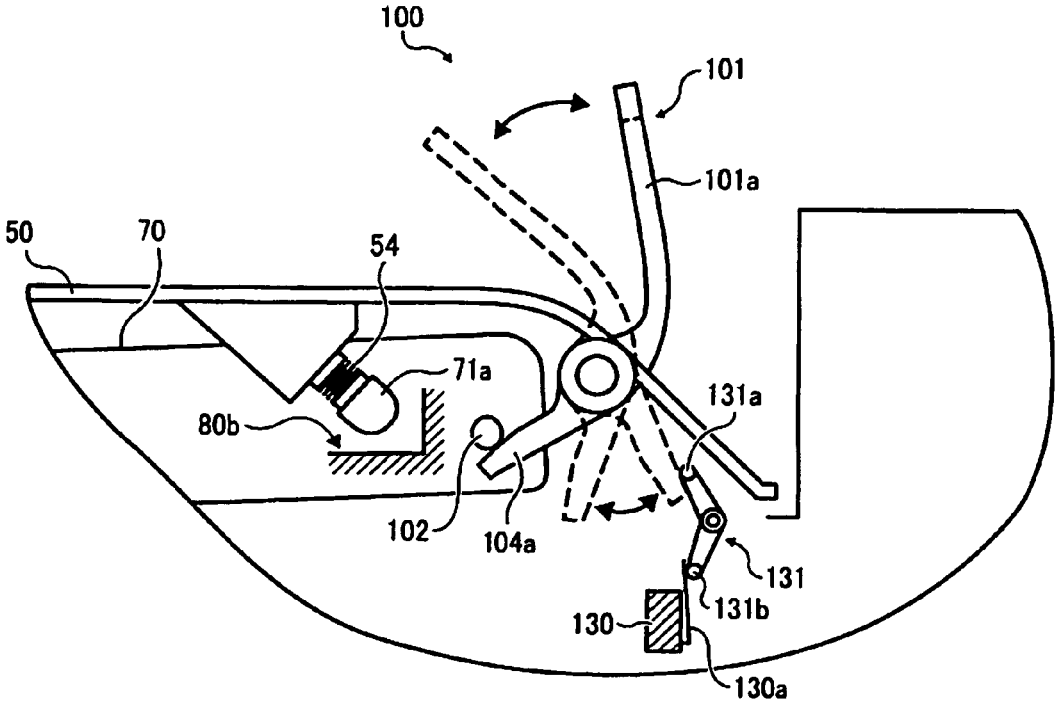
FIG. 19 is an overall configuration diagram of a third example.

FIG. 19 is an overall configuration diagram of the third example. In the third example, an interlock switch 130 is turned ON when the first reference position component 71*a* and the second reference position component 71*b* are in the contacting position, allowing processing sections of the photoreceptors, the charging unit 4K, the developing unit 5K, the optical writing device 70, and the like to be driven.

As shown in FIG. 19, a roughly dog-legged swinging arm 131 is fixed onto one side surface side of the printer main body such as to swing freely. A lever contacting member 131*a* is provided on an upper end of the swinging arm 131. A switch contacting member 131*b* is provided on a lower end of the swinging arm 131.

When the lower end of the first engaging member 104*a* lifts the optical writing device 70 through the retracted contacting member, as indicated by a solid line in FIG. 19, and the first reference position component 71*a* and the second reference position component 71*b* are at the retracted position, the interlock switch 130 is turned OFF. Connection between each processing section and a power supply (not shown) is broken. As a result, images cannot be formed when the optical writing device 70 is not positioned in relation to the printer main body.

When the lever 101 is pushed in a direction indicated by dotted lines in FIG. 19, the first engaging member 104*a* separates from the retracted contacting position. The positions of the first reference position component 71*a* and the second reference position component 71*b* switch to the contacting position by a biasing force from the biasing coil spring 54. The optical writing device 70 is positioned in relation to the printer main body. When the lever 101 is pushed further downward, the lower end of the first engaging member 104*a* comes into contact with the lever contacting member 131*a* of the swinging arm 131. When the lever 101 is pushed further downward, the swinging arm 131 rotates. The switch contacting member 131*b* of the swinging arm 131 comes into contact with a lever section 130*a* of the interlock switch 130. When the lever 101 is pushed further downward, the swinging arm 131 presses the lever section 130*a* against the interlock switch 130 and presses a button (not shown) of the interlock switch 130. The interlock switch 130 switches from OFF to ON. Each processing section and the power supply are connected, allowing each processing section to be driven. As a result, the image forming operation can be performed.

In the third example, when the optical writing device 70 is not positioned in relation to the printer main body, the images are not formed. Therefore, formation of abnormal images, such as an image with color-shifting, can be suppressed. The image forming operation is prohibited when the optical writing device 70 is not positioned in relation to the printer main body in terms of hardware. Therefore, unlike when the image forming operation is prohibited through software, as in the second example, the image forming operation being performed as a result of a runaway software process does not occur. The image forming operation can be prohibited with more certainty. Moreover, complication control operations are not required. The image forming operation can be prohibited through a simple configuration, there by achieving cost reduction.

Figure 20:
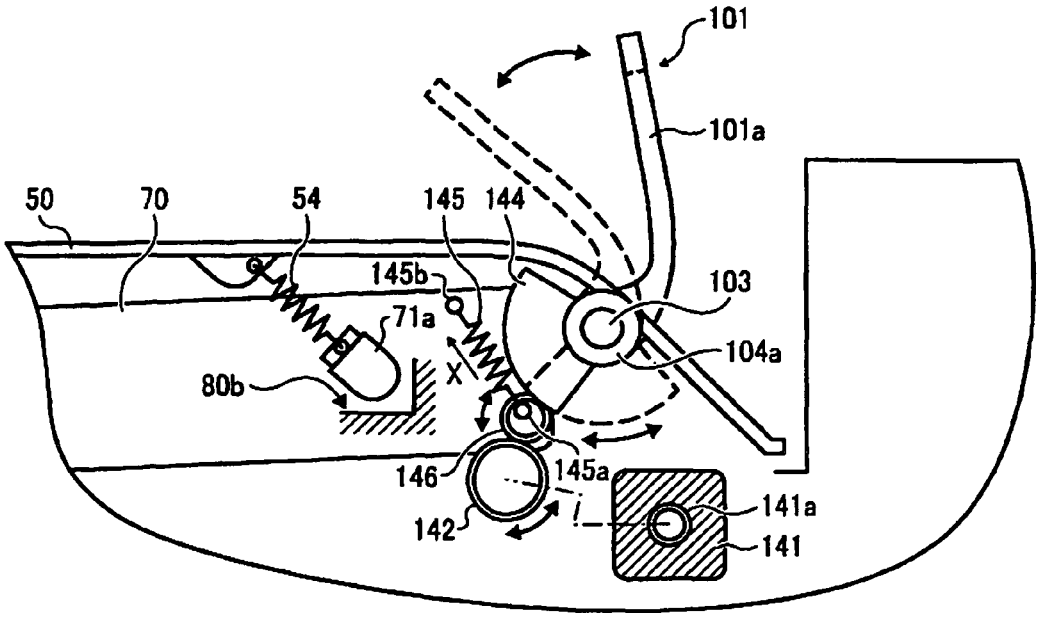
FIG. 20 is an overall configuration diagram of a fourth example.

FIG. 20 is an overall configuration diagram of the fourth example. In the fourth example, a switching motor 14 serving as a driving section is provided. As a result of the switching motor 14 being driven, the positions of the first reference position component 71*a* and the second reference position component 71*b* are switched between the retracted position and the contacting position.

As shown in FIG. 20, in the fourth example, a switching motor 141 is provided on one side surface side of the printer main body. A driving gear 142 is fixed onto a rotation axis (not shown) held by the printer main body such as rotate freely. On a surface of the first frame of the cover frame 52 (not shown) on the optical writing device 70 side, a driven gear 146 is attached such as to rotate freely. When the optical writing device 70 is in the closed position, the driven gear 146 meshes with the driving gear 142. A fan-shaped lever gear 144 is attached to the first engaging member 104*a*. The lever gear 144 meshes with the driven gear 146. A first spring attaching section 145*a* is provided on the first engaging member 104*a*. One end of a retraction coil spring 145 is attached to the first spring attaching section 145*a*. A second spring attaching section 145*b* is provided on a surface of the first frame of the cover frame 52 (not shown) on the optical writing device 70 side. Another end of the retraction coil spring 145 is attached to the second spring attaching section 145*b*. When the lever 101 is at the pulled-up position indicated by a solid line in FIG. 20, the retraction coil spring 145 is at a free length. When the lever 101 moves to a pushed-down position indicated by a dotted line in FIG. 20, from the pulled-up position, the retraction coil spring 145 expands, biasing the lower end of the first engaging member 104*a* in an X-direction in FIG. 20.

When the optical writing device 70 is moved from the closed position to the open position, the switching motor 141 is driven. Drive is transmitted to the driving gear 142 by a drive transmitting mechanism (not shown). The drive is then transmitted from the driving gear 142 to the driven gear 146. The lever gear 144 rotates in the clockwise direction in FIG. 20. The lever 101 rises to the pulled-up position indicated by the solid line in FIG. 20. At this time, the second engaging member (not shown) lifts the optical writing device 70. The positions of the first reference position component 71*a* and the second reference position component 71*b* switch from the contacting position to the retracted position. When the lever 101 reaches the pulled-up position, the drive of the switching motor 141 is stopped. The user lifts the connecting member 101*b* of the lever 101 and moves the optical writing device 70 to the open position.

Even when the lever 101 falls when the optical writing device 70 is in the open position, the lever 101 is returned to the pulled-up position by a biasing force of the retraction coil spring 145. Therefore, when the optical writing device 70 is in the open position, the first reference position component 71*a* and the second reference position component 71*b* can always be positioned at the retracted position. Therefore, when the optical writing device 70 is moved from the open position to the closed position, the first reference position component 71*a* and the second reference position component 71*b* do not collide with the first positioning member 80*b* and the second positioning member 90*b*.

Although there is risk of the driven gear 146 colliding with the driving gear 142, impact of the collision can be prevented from being transmitted to the optical writing device 70 by a following configuration. The rotation axis onto which the driving gear 142 is fixed is allowed to move in a collision direction. The rotation axis is biased by a biasing member, such as a spring, in a direction opposite to the collision direction. Force of the collision is received by the printer main body side.

When the optical writing device 70 is moved from the open position to the closed position, an upper cover open-and-close detecting member (not shown) detects that the upper cover 50 is closed. The switching motor 141 is rotatably driven in a direction opposite of that when the optical writing device 70 is moved from the closed position to the open position. As a result, the lever 101 starts to fall. The second engaging member (not shown) separates from the second retracted contacting member (not shown). The positions of the first reference position component 71*a* and the second reference position component 71*b* switch from the retracted position to the contacting position. As a result, the optical writing device 70 is positioned in relation to the printing main body.

At this time, the lever 101 is biased to the pulled-up position indicated by the solid line in FIG. 20 by the retraction coil spring 145. However, movement of the lever 101 to the pulled-up position is restricted by the switching motor 141.

In the fourth example, the switching motor 141 switches the positions of the first reference position component 71*a* and the second reference position component 71*b*. Therefore, unlike when the switching is manually performed, the positions of the first reference position component 71*a* and the second reference position component 71*b* are not switched while power of the image forming apparatus is turned OFF. Therefore, the positions of the first reference position component 71*a* and the second reference position component 71*b* can be always known. As a result, whether the first reference position component 71*a* and the second reference position component 71*b* are in the contacting position and the image forming operation can be performed, or the first reference position component 71*a* and the second reference position component 71*b* are in the retracted position and the image forming operation cannot be performed, can be displayed in an operation display of the printer, a screen of a personal computer, and the like.

Figure 21:
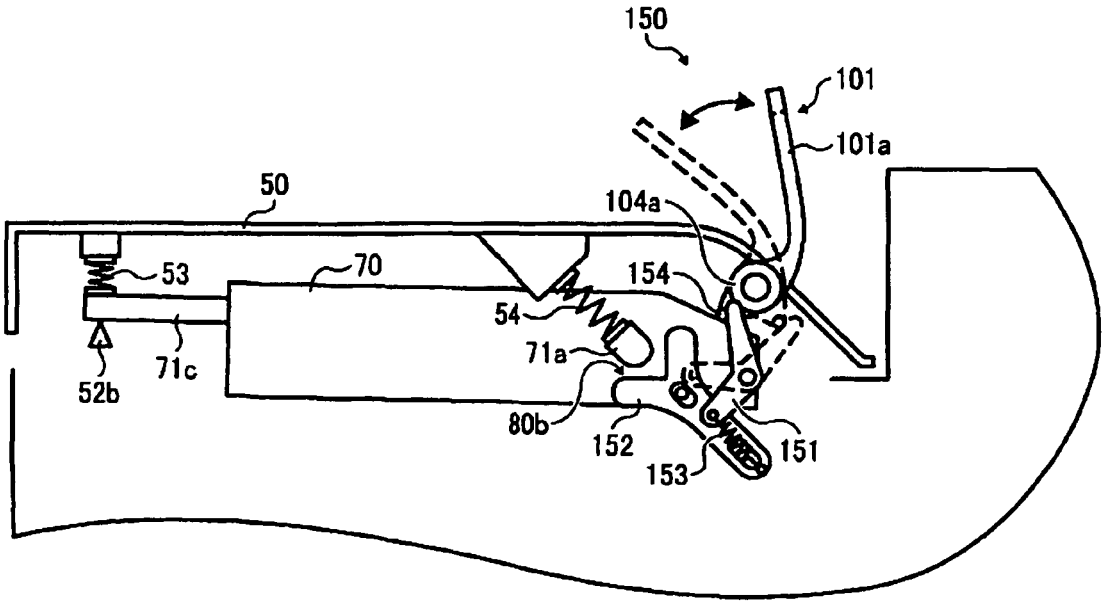
FIG. 21 is an overall configuration diagram of a fourth example.

FIG. 21 is an overall configuration diagram of the fifth example. In the fifth example, the first positioning member 80*b* and the second positioning member 90*b* can be switched between the contacting position and the retracted position.

As shown in FIG. 21, a switching mechanism 150 in the fifth example includes a first positioning member moving component 152, a second positioning member moving component (not shown), a first swinging component 151, a second swinging component (not shown), and the lever 101. The roughly L-shaped first positioning member 80*b* is provided on an upper end of the first positioning member moving component 152. Two long holes are formed on the first positioning member moving component 152. An engaging pin projecting from one side surface of the printer main body is engaged with a long hole. The first positioning member moving component 152 is attached to the one side surface of the printer main body to allow movement in a same direction as the biasing direction of the biasing coil spring 54. The first swinging component 151 is roughly dog-legged. The first swinging component 151 is attached to the one side surface of the printer main body to allow rotation. One end of a first coil spring 153 is attached to a lower end of the first swinging component 151. Another end of the first coil spring 153 is attached to a lower end of the first positioning member moving component 152. Although this is not shown, a long hole on the second positioning member moving component is engaged with an engaging pin projecting from the other side surface of the printer main body. The second positioning member moving component is attached to the other side surface of the printer main body to allow movement in a same direction as the biasing direction of the biasing coil spring. The second swinging component is attached to the other side surface of the printer main body to allow rotation. A second coil spring is attached to a lower end of the second swinging component and a lower end of the second positioning member moving component. As in the examples above, the lever 101 includes the first arm 101*a*, the second arm (not shown), the connecting member (not shown), the first axial component, the second axial component, the first engaging member, and the second engaging member. A contacting projection 154 that comes into contact with the first swinging component 151 is provided on the lower ends of the first engaging member 104*a* and the second engaging member.

When the lever 101 is at the lever-housed position at which the first positioning member 80*b*, the second positioning member 90*b*, the first reference position component 71*a*, and the second reference position component 71*b* are positioned at the contacting positions, the lever 101 engages with an engaging member (not shown) provided on the upper cover 50.

When the lever 101 is at the lever-housed position at which the lever 101 is housed in the lever housing (not shown) on the upper cover, the first swinging component 151 and the second swinging component (not shown) are positioned as indicated by dotted lines in FIG. 21. At this time, the first swinging component 151 is biased in a direction at which the first swinging component 151 rotates in the counter-clockwise direction in FIG. 21 by the first coil spring 153. Similarly, the second swinging component is biased in a direction at which the second swinging component rotates in the counter-clockwise direction by the second coil spring (not shown).

When the optical writing device 70 is moved from the closed position to the open position, a releasing section (not shown) releases the engagement between the engaging member provided on the upper cover 50 and the lever 101. As a result of the first coil spring 153 and the second coil spring, the first swinging component 151 and the second swinging component rotate in the counter-clockwise direction until the lower ends of the first swinging component 151 and the second swinging component reach a position indicated by solid lines in FIG. 21. The lever 101 is rotated to the pulled-up position indicated by solid lines in FIG. 21. The first positioning member moving component 152 and the second positioning member moving component (not shown) move from the contacting position to the biasing direction side of the biasing coil spring 54. The positions of the first positioning member 80*b* and the second positioning member 90*b* switch from the contacting position to the retracting position. The optical writing device 70 can then be moved from the closed position to the open position by the user holding the connecting member of the lever 101 and pulling the lever 101 upwards.

When the optical writing device 70 is at the open position, the locking mechanism shown in FIG. 15 preferably locks the lever 101 to prevent the lever 101 from falling. As a result, when the optical writing device 70 is moved from the open position to the closed position, the contacting projection 154 provided on the lower ends of the arms of the lever 101 can be positioned closer to the optical writing device 70 side than the first swinging component 151 and the second swinging component.

When the optical writing device 70 is moved from the open position to the closed position, the first positioning member 80*b* and the second positioning member 90*b* are positioned at the retracting position. Therefore, the first reference position component 71*a* and the second reference position component 71*b* do not collide with the first positioning member 80*b* and the second positioning member 90*b*

After the optical writing device 70 is moved to the closed position, the lever 101 is pushed toward the lever-housed position. The contacting projection 154 of the first engaging member 104*a* then comes into contact with a surface of the upper end of the first swinging component 151 on the optical writing device 70 side. The first swinging component 151 is rotated in the clockwise direction. Similarly, the contacting projection of the second engaging member comes into contact with a surface of the upper end of the second swinging component on the optical writing device 70 side (not shown). The second swinging component is rotated in the clockwise direction. As a result of the first swinging component 151 and the second swinging component being rotated, the first positioning member moving component 152 and the second positioning member moving component move in the direction opposite to the biasing direction of the biasing coil spring 54. The positions of the first positioning member 80*b* and the second positioning member 90*b* switch from the retracted position to the contacting position. Then, when the lever 101 reaches the lever-housed position and is housed in the lever housing 50*a* (not shown) provided on the upper cover 50, the lever 101 engages with the engaging member (not shown) on the upper cover 50.

As described above, the image forming apparatus according to the embodiment includes photoreceptors 2, the optical writing device 70, and the cover frame 52. The photoreceptors 2 serve as the latent image carriers carrying a latent image on a front surface that moves endlessly. The optical writing device 70 serves as the latent image writing unit that writes the latent image onto the photoreceptors 2. The cover frame 52 serves as the holding body that can rotate between the open position and the closed position in relation to the printer main body with a rotation axis provided on the printer main body as a center, while holding the optical writing device 70. The first reference position component 71*a* and the second reference position component 71*b* are provided at positioning reference positions on the optical writing device 70. The first positioning member 80*b* and the second positioning member 90*b* that are used to position the optical writing device 70 in the closed position are provided within the image forming apparatus. The first reference position component 71*a* and the second reference position component 71*b* are biased by the biasing coil spring serving as the biasing member. The first reference position component 71*a* and the second reference position component 71*b* then come into contact with the first positioning member 80*b* and the second positioning member 90*b*. When the optical writing device 70 is at the closed position, the printer can enter two states: a contacting state or a non-contacting state. In the contacting state, the first positioning member 80*b* and the first reference position component 71*a*, and the second positioning member 90*b* and the second reference position component 71*b* are in contact. In the non-contacting state, the first positioning member 80*b* and the first reference position component 71*a*, and the second positioning member 90*b* and the second reference position component 71*b* are not in contact. The switching mechanism 100 serving as the switching member switches between the contacting state and the non-contacting state. As a result, if the printer is switched to the non-contacting state in which the first positioning member 80*b* and the first reference position component 71*a*, and the second positioning member 90*b* and the second reference position component 71*b* are not in contact when the optical writing device 70 moves from the open position to the closed position, the first reference position component 71*a* and the second reference position component 71*b* can be prevented from colliding with the first positioning member 80*b* and the second positioning member 90*b* when the optical writing device 70 moves from the open position to the closed position. Therefore, shifting of the positions of the lenses, mirrors, and the like positioned and fixed within the casing of the optical writing device 70 can be suppressed.

When the switching mechanism 100 switches to the contacting state in which the first positioning member 80*b* and the first reference position component 71*a*, and the second positioning member 90*b* and the second reference position component 71*b* are in contact, when the optical writing device 70 is in the closed position, the optical writing device 70 can be positioned in relation to the photoreceptors 2 within the image forming apparatus at the closed position. The decrease in the writing position accuracy of the optical writing device 70 can be suppressed.

In the first example, in at least the closed position, the first reference position component 71*a* and the second reference position component 71*b* can be in the contacting position that actualizes the contacting state or the retracted position that actualizes the non-contacting state as a result of the optical writing device 70 moving, by switching performed by the switching mechanism 100. As a result, the switching performed by the switching mechanism 100 can switch between the contacting state and the non-contacting state.

As in the fifth example, in at least the closed position, the first positioning member 80*b* and the second positioning member 90*b* can be in the contacting position that actualizes the contacting state or the retracted position that actualizes the non-contacting state, by the switching performed by the switching mechanism 100. In this configuration as well, the switching performed by the switching mechanism 100 can switch between the contacting state and the non-contacting state.

The lever 101 serving as the switching controlling member that controls the switching between the contacting state and the non-contacting state is provided. The lever 101 functions as the movement controlling member that controls the movement of the optical writing device 70 between the closed position and the open position. As a result, compared to when the switching controlling member and the movement controlling member are separately provided, the number of components can be reduced. Cost reduction and size reduction of the image forming apparatus can be achieved.

The locking mechanism 160 that locks the lever 101 at the pulled-up position that is the second position is provided. Therefore, even when the lever 101 starts to fall, the lever 101 can be prevented from falling by the locking mechanism 160. As a result, the lever 101 does not change positions from the pulled-up position that is the second position to the lever-housed position that is the first position when the optical writing device 70 moves from the open position to the closed position. Therefore, when the optical writing device 70 moves from the open position to the closed position, the first reference position component 71*a* and the second reference position component 71*b* can be positioned at the retracted position with certainty. The first reference position component 71*a* and the second reference position component 71*b* can be prevented from colliding with the first positioning member 80*b* and the second positioning member 90*b* with certainty.

The locked lever 101 is released by the release lever. Therefore, unless the release lever is operated, the locked lever 101 cannot be released. The lever 101 can be prevented from falling with more certainty.

In the second example, the detector 110 is provided. The detector 110 detects whether the printer is in the contacting state when the optical writing device is at the closed position. As a result, from a detection result from the detector 110, whether the optical writing device 70 is positioned in relation to the printer main body can be detected.

In the third example, the interlock switch is provided. The interlock switch switches between a state allowing the image forming operation to be performed and a state prohibiting the image forming operation. In the contacting state, the interlock switch is switched to ON, allowing the image forming operation to be performed. As a result of the configuration, the image forming operation can be performed only when the first reference position component 71*a* and the first positioning member 80*b*, and the second reference position component 71*b* and the second positioning member 90*b* are in contact, and the optical writing device is positioned in relation to the printer main body. Therefore, formation of abnormal images, such as an image with color-shifting, can be suppressed.

In the fourth example, the switching motor serving as a driving section is provided. The drive from the switching motor is used to switch between the non-contacting state and the contacting state. As a result, unlike when the switching is manually performed, the positions of the first reference position component 71*a* and the second reference position component 71*b* do not switch when the power of the image forming apparatus is OFF. Therefore, the positions of the first reference position component 71*a* and the second reference position component 71*b* can always be known. As a result, whether the first reference position component 71*a* and the second reference position component 71*b* are in the contacting position and the image forming operation can be performed, or the first reference position component 71*a* and the second reference position component 71*b* are in the retracted position and the image forming operation cannot be performed, can be displayed in an operation display of the printer, a screen of a personal computer, and the like.

According to an aspect of the present invention, if a switching section switches the image forming apparatus to a non-contacting state in which a positioning section and a reference position component are not in contact when a holding body holding a latent image writing section moves from an open position to a closed position, the reference position component can be prevented from colliding with the positioning section when the holding body holding the latent image writing section moves from the open position to the closed position. As a result, shifting of positions of lenses, mirrors, and the like positioned and fixed within a casing of the latent image writing section can be suppressed.

When the switching section switches the image forming apparatus to a contacting state in which the positioning section and the reference position component are in contact when the holding body is in the closed position, the latent image writing section can be positioned at an operating position in relation to a latent image carrier within the image forming apparatus. Decrease in writing position accuracy of the latent image writing section can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier that carries a latent image;

a latent image writing unit that writes the latent image on the latent image carrier;

a holding body that can swing between an open position and a closed position with respect to an apparatus main body with a rotation axis provided on the apparatus main body as a center while holding the latent image writing unit, in which a reference position component is provided at a positioning reference position of the latent image writing unit, a positioning member is provided within the apparatus main body to position the latent image writing unit in relation to the latent image carrier when the holding body is in the closed position, and the reference position component is biased by a biasing member so as to come into contact with the positioning member;

a mechanism that puts, when the holding body is in the closed position, the positioning member and the reference position component in any one of a contacting state in which the positioning member and the reference position component are in contact and a non-contacting state in which the positioning member and the reference position component are not in contact; and a switching member configured to switch between the contacting state and the non-contacting state.

2. The image forming apparatus according to claim 1, wherein, when at least the holding body is in the closed position, the reference position component can be in a contacting position that actualizes the contacting state or a retracted position that actualizes the non-contacting state as a result of the latent image writing unit moving in relation to the holding body when the switching member performs switching.

3. The image forming apparatus according to claim 1, wherein, when at least the holding body is in the closed position, the positioning member can be in a contacting position that actualizes the contacting state or a retracted position that actualizes the non-contacting state when the switching member performs switching.

4. The image forming apparatus according to claim 1, wherein the switching member includes a switching controlling member that controls switching between the contacting state and the non-contacting state, and the switching controlling member functions as a movement controlling member that controls movement of the holding body between the closed position and the open position.

5. The image forming apparatus according to claim 4, wherein the switching controlling member can change positions between a first position and a second position, wherein the positioning member and the reference position component are put in the contacting state when the switching controlling member is in the first position and the positioning member and the reference position component are put in the non-contacting state when the switching controlling member is in the second position, and the image forming apparatus further comprises a locking mechanism to lock the switching controlling member at the second position.

6. The image forming apparatus according to claim 5, comprising a release lever that releases the switching controlling member if the switching controlling member is locked.

7. The image forming apparatus according to claim 1, further comprising a detecting member that detects whether the positioning member and the reference position component are put in the contacting state when the holding body is in the closed position.

8. The image forming apparatus according to claim 1, further comprising an interlock switch that switches between a state allowing an image forming operation to be performed and a state prohibiting the image forming operation, wherein, in the contacting state, the interlock switch switches to ON, allowing the image forming operation to be performed.

9. The image forming apparatus according to claim 1, further comprising a driving unit that drives the switching member so as to switch between the non-contacting state and the contacting state.

* * * * *